US008733914B2

(12) United States Patent
Ishizawa et al.

(10) Patent No.: US 8,733,914 B2
(45) Date of Patent: May 27, 2014

(54) METHOD OF MANUFACTURING A LIQUID CONTAINER

(71) Applicant: Seiko Epson Corporation, Tokyo (JP)

(72) Inventors: Taku Ishizawa, Shiojiri (JP); Hiroyuki Kawate, Hokuto (JP); Hiroshi Nose, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/754,219

(22) Filed: Jan. 30, 2013

(65) Prior Publication Data

US 2013/0321534 A1 Dec. 5, 2013

(30) Foreign Application Priority Data

May 31, 2012 (JP) ..... 2012-124157

(51) Int. Cl.
*B41J 2/175* (2006.01)

(52) U.S. Cl.
USPC ..... 347/86

(58) Field of Classification Search
USPC ..... 347/7, 86, 87
See application file for complete search history.

(56) References Cited

U.S. PATENT DOCUMENTS

| | | | | |
|---|---|---|---|---|
| 6,361,136 | B1 * | 3/2002 | Watanabe et al. | 347/7 |
| 6,454,400 | B1 * | 9/2002 | Morita et al. | 347/86 |
| 7,445,322 | B2 * | 11/2008 | Kitabatake et al. | 347/86 |
| 7,942,510 | B2 | 5/2011 | Shinada et al. | |
| 8,142,000 | B2 | 3/2012 | Ishizawa et al. | |
| 8,177,342 | B2 | 5/2012 | Wanibe et al. | |
| 8,382,265 | B2 * | 2/2013 | Matsumoto et al. | 347/86 |
| 2010/0073438 | A1 | 3/2010 | Wanibe et al. | |

FOREIGN PATENT DOCUMENTS

| | | | |
|---|---|---|---|
| JP | 09-174870 | A | 7/1997 |
| JP | 2008-044193 | A | 2/2008 |
| JP | 2010-005956 | A | 1/2010 |
| JP | 2010-005957 | A | 1/2010 |
| JP | 2010-005958 | A | 1/2010 |

* cited by examiner

*Primary Examiner* — Ahn T. N. Vo
(74) *Attorney, Agent, or Firm* — Stroock & Stroock & Lavan LLP

(57) ABSTRACT

A method of manufacturing a liquid container includes (a) a process of preparing a liquid container, (b) a process of storing liquid in a liquid storage chamber by injecting the liquid from the liquid storage chamber or an upstream side of the liquid storage chamber in a channel from an atmosphere opening port to a supply port based on a flow direction of a fluid from the atmosphere opening port to the supply port.

20 Claims, 18 Drawing Sheets

METHOD OF MANUFACTURING A LIQUID CONTAINER

Priority is claimed on Japanese Patent Application No. 2012-124157, filed May 31, 2012 under 35 U.S.C. §119, the content of which is incorporated herein by reference.

BACKGROUND

1. Technical Field

The present invention relates to a technology of a liquid container.

2. Related Art

In the related art, as a technology which supplies ink to a printer which is an example of a liquid ejecting apparatus, a technology which uses an ink cartridge (simply referred to as a "cartridge") is known. The cartridge is manufactured by injecting ink to the inner portion. The cartridge which is mounted on the printer circulates the ink in the inner portion to the printer through a supply port. In the related art, if the ink is consumed and a residual quantity of the inner portion is zero or a small amount, the cartridge is changed to a new product. Moreover, the cartridge may be remanufactured by injecting ink to the used cartridge again. As the cartridge, the type of cartridge, which includes a buffer chamber having a predetermined volume at the downstream side of a liquid storage chamber in addition to the liquid storage chamber in which the injected ink is stored, is known (for example, Patent Document 1). As disclosed in Patent Document 1, the above-described cartridge type includes a narrow channel (a first flow passage and a second flow passage) having a small channel cross-sectional area in a portion of the channel which causes an ink storage portion, which is the liquid storage chamber, and the buffer chamber to communicate with each other.

[Patent Document 1] JP-A-2010-5958

Here, when the ink is injected into the cartridge from the buffer chamber and the ink is stored in the liquid storage chamber, bubbles which occur at the time of the ink injection stay in the narrow channel, and bubbles may impede a flow of the ink from the buffer chamber to the liquid storage chamber. Thereby, when the buffer chamber is set to the ink injection location, the ink may not be efficiently stored in the liquid storage chamber.

Moreover, the cartridge may include a detection member (for example, a piezoelectric element or a prism, and also referred to a first member) which can be used for detecting an ink residual quantity state (presence or absence of the ink residual quantity or the ink residual quantity). Here, in the cartridge, bubbles may occur in the inner portion at the time of the ink injection or after the ink injection. Here, in the cartridge which includes the detection member, if the bubbles which occur in the inner portion reach the detection member, there is a concern that accuracy of the detection of the ink residual quantity state which uses the detection member may be decreased.

The above-described problems are not limited to the cartridge for storing ink in the inner portion, and are common to liquid containers for storing other kinds of liquid except the ink.

The present invention is made in order to solve at least a portion of the above-described problems, and a first object thereof is to provide a technology capable of effectively storing liquid in a liquid storage chamber of a liquid container from the outside. In addition, a second object thereof is to provide a technology capable of decreasing the possibility that bubbles, which occur in the inner portion of the liquid container, may reach a first member.

SUMMARY

The present invention is made in order to solve at least a portion of the above-described problems and can be realized according to the following aspects or Application Examples.

APPLICATION EXAMPLE 1

According to an aspect of the present invention, there is provided a method of manufacturing a liquid container which stores liquid supplied to a liquid ejecting apparatus, including: (a) a process of preparing a liquid container, in which the liquid container includes: a liquid storage chamber for storing the liquid; a first member which is disposed in the liquid storage chamber and in which a reflection state of light of a surface is changed according to a refractive index of a fluid which comes into contact with the surface; a liquid guiding channel in which a supply port connected to the liquid ejecting apparatus is formed on one end and which communicates with the liquid storage chamber and circulates the liquid of the liquid storage chamber to the liquid ejecting apparatus through the supply port; and an atmosphere introduction channel in which an atmosphere opening port for introducing the atmosphere is formed on one end and which communicates with the liquid storage chamber and circulates the atmosphere introduced from the atmosphere opening port into the liquid storage chamber, and the liquid guiding channel includes an narrow channel, in which a channel cross-sectional area is smaller than a portion in which the first member is disposed, in the liquid storage chamber; and (b) a process of storing the liquid in a liquid storage chamber by injecting the liquid from the liquid storage chamber or an upstream side of the liquid storage chamber in a channel from the atmosphere opening port to the supply port based on a flow direction of a fluid from the atmosphere opening port to the supply port. According to the method of manufacturing a liquid container described in Application Example 1, the liquid is injected from the liquid storage chamber or the upstream side of the liquid storage chamber. Here, the liquid storage chamber or the upstream side portion of the liquid storage chamber is positioned at the upstream side of the narrow channel. Accordingly, the liquid can be stored in the liquid storage chamber without passing through the narrow channel. Thereby, at the time of the process (b), the possibility that bubbles may stay in the narrow channel and thus, the injection of the liquid to the liquid storage chamber may be impeded can be decreased. That is, the liquid can be effectively stored in the liquid storage chamber.

APPLICATION EXAMPLE 2

In the method of manufacturing a liquid container according to Application Example 1, the liquid storage chamber includes: a first storage chamber in which the first member is disposed; a second storage chamber which is positioned at an upstream side of the first storage chamber based on the flow direction of the fluid; and a liquid communication channel which communicates with the first storage chamber and the second storage chamber, and in the process (b), a portion which injects the liquid is positioned in the first storage chamber. According to the method of manufacturing a liquid container described in Application Example 2, the liquid is directly injected to the liquid storage chamber. Thereby, the liquid can be more effectively stored in the liquid storage chamber.

APPLICATION EXAMPLE 3

In the method of manufacturing a liquid container according to Application Example 2, the first member is transparent or translucent and disposed so that an inner portion of the liquid storage chamber is viewed through the first member from the outside, and in the process (b), the portion which injects the liquid is disposed at the portion, in which the inner portion of the first storage chamber can be viewed from the outside through the first member, in the first storage chamber. According to the method of manufacturing a liquid container described in Application Example 3, the aspect in which the liquid is injected to the liquid storage chamber can be confirmed from the outside through the first member.

APPLICATION EXAMPLE 4

In the method of manufacturing a liquid container according to Application Example 2, the first storage chamber includes: a plurality of partitioned storage chambers which are partitioned by a plurality of partition walls; and a plurality of storage chamber communication ports which are formed so that the liquid circulates between the plurality of partitioned storage chambers and are formed by a gap between an opened end of the partition wall and an outer wall surface of the first storage chamber, the plurality of partitioned storage chamber includes: a first member storage chamber which includes a first member disposition surface in which the first member is disposed, a first partitioned storage chamber which directly communicates with the liquid communication channel, directly communicates with the first member storage chamber by a communication port of a first storage chamber which is one of the plurality of storage chamber communication ports, and is disposed above the first member storage chamber in a mounting state in which the liquid container is mounted on the liquid ejecting apparatus disposed in a horizontal plane; and a second partitioned storage chamber which does not directly communicate with the first partitioned storage chamber and directly communicates with the first member storage chamber by a communication port of a second storage chamber which is the other one of the plurality of storage chamber communication ports, and the first member storage chamber include a first inner wall which is disposed so as to cover the first member at a position between the upper surface of the first member storage chamber and the first member and inclined so as to be gradually higher from one end connected to the outer wall of the first storage chamber toward the opened other end, in the mounting state. According to the method of manufacturing a liquid container described in Application Example 4, the first member storage chamber in which the first member is disposed includes the inclined first inner wall. Thereby, even when bubbles occur in the first member storage chamber in the process (b) or the like, the bubbles which exist around the first member can move in the direction, which is away from the first member, along the first inner wall by making the liquid container to a mounting state. Thereby, the possibility that bubbles may reach the first member and be attached thereto can be decreased.

APPLICATION EXAMPLE 5

In the method of manufacturing a liquid container according to Application Example 4, the upper surface of the first member storage chamber includes: a first partition wall of the plurality of partition walls which partitions the first member storage chamber and first partitioned storage chamber; and a second partition wall of the plurality of partition walls which partitions the first member storage chamber and the second partitioned storage chamber, each of the first partition wall and the second partition wall is inclined so as to be gradually higher in the mounting state as the walls approach the communication port of the first storage chamber from one end and are toward the other end, and in the process (b), the portion which injects the liquid is positioned in the first member storage chamber. According to the method of manufacturing a liquid container described in Application Example 5, the liquid can be injected from the first member storage chamber in which the first member is disposed. Moreover, the upper surface of the first member storage chamber includes the first partition wall and the second partition wall which are inclined so as to be gradually higher toward the communication port of the first storage chamber. Thereby, even when bubbles occur in the first member storage chamber at the time of the process (b), at the time of transporting, or the like, the bubbles can be led to the communication port of the first storage chamber by making the liquid container to the mounting state. Thereby, the possibility that bubbles may reach the first member and be attached thereto can be decreased.

APPLICATION EXAMPLE 6

In the method of manufacturing a liquid container according to Application Example 5, in the process (b), the portion which injects the liquid is disposed in a first bottom chamber, which is interposed by the first inner wall and the first member disposition surface, in the first member storage chamber. According to the method of manufacturing a liquid container described in Application Example 6, the liquid is injected from the first bottom chamber in the first member storage chamber.

APPLICATION EXAMPLE 7

In the method of manufacturing a liquid container according to Application Example 5, in the mounting state, the first member storage chamber includes: a first bottom chamber which is interposed by the first inner wall and the first member disposition surface; and a second bottom chamber which is a portion other than the first bottom chamber, and in the process (b), the portion which injects the liquid is positioned in the second bottom chamber. According to the method of manufacturing a liquid container according to Application Example 7, the second bottom chamber is a chamber different from the first bottom chamber in which the first member is disposed. Accordingly, since the liquid is injected from the second bottom chamber, even when bubbles occur at the time of the liquid injection, the possibility that bubbles may reach the first member can be decreased.

APPLICATION EXAMPLE 8

In the method of manufacturing a liquid container described in Application Example 7, the second bottom chamber includes: a first division chamber which has the first inner wall as a bottom surface and a portion of the first partition wall as an upper surface in the mounting state; and a second division chamber which is a portion other than the first division chamber and has the other portion of the first partition wall and the second partition wall as a portion of an upper surface in the mounting state, and in the process (b), the portion which injects the liquid is positioned in the first division chamber. According to the method of manufacturing a liquid container described in Application Example 8, the first inner wall is disposed between the first division chamber and the first member. Accordingly, since the liquid is injected from the first division chamber, even when bubbles occur at the time of the liquid injection, the possibility that the generated bubbles may reach the first member can be decreased. In addition, the upper surface of the first division chamber in the mounting state is the first partition wall which is inclined in a predetermined direction. Accordingly, even when bubbles occur in the first division chamber at the time of the process (b), at the time of transporting, or the like, the bubbles can be led to the communication port of the first storage chamber along the first partition wall by making the liquid container to the mounting state. Thereby, the possibility that bubbles may reach the first member and be attached thereto can be decreased.

APPLICATION EXAMPLE 9

In the method of manufacturing a liquid container according to Application Example 7, the second bottom chamber includes: a first division chamber which has the first inner wall as a bottom surface and a portion of the first partition wall as an upper surface in the mounting state; and a second division chamber which is a portion other than the first division chamber and has the other portion of the first partition wall and the second partition wall as a portion of an upper surface in the mounting state, and in the process (b), the portion which injects the liquid is positioned in the second division chamber. According to the method of manufacturing a liquid container described in Application Example 9, the liquid can be injected from the second division chamber. Moreover, the upper surface of the second division chamber in the mounting state includes the other portion of the first partition wall which is inclined in a predetermined direction and the second partition wall which is inclined in a predetermined direction. Accordingly, even when bubbles occur in the second division chamber at the time of the process (b), at the time of transporting, or the like, the bubbles can be led to the communication port of the first storage chamber along the first partition wall or the second partition wall by making the liquid container to the mounting state. Thereby, the possibility that bubbles may reach the first member and be attached thereto can be decreased.

APPLICATION EXAMPLE 10

In the method of manufacturing a liquid container according to Application Example 4, in the mounting state, the second partitioned storage chamber is positioned above the first member storage chamber and is provided in a different position which does not overlap with the first member when the liquid container is vertically projected on the horizontal plane, the communication port of the second storage chamber is formed so that the first member is not positioned in an opening direction, and in the process (b), the portion which injects the liquid is positioned in the second partitioned storage chamber. According to the method of manufacturing a liquid container described in Application Example 10, since the first member is not positioned in the opening direction of the communication port of the second storage chamber, even though bubbles occur when the liquid is injected from the second partitioned storage chamber, the possibility that the bubbles may reach the first member through the communication port of the second storage chamber can be decreased.

APPLICATION EXAMPLE 11

In the method of manufacturing a liquid container according to Application Example 10, the communication port of the second storage chamber is formed in the lower end of the second partitioned storage chamber in the mounting state, and the opening direction includes a vertical direction component in the mounting state. According to the method of manufacturing a liquid container described in Application Example 11, even though bubbles occur when the liquid is injected from the second partitioned storage chamber, the bubbles can be caught in the second partitioned storage chamber by making the liquid container to the mounting state. Thereby, the possibility that bubbles may reach the first member can be decreased. In addition, even when bubbles exist in the first storage chamber, the bubbles can be led to the second partitioned storage chamber which is positioned above the first member storage chamber in the mounting state. Thereby, the quantity of bubbles in the first member storage chamber can be decreased, and the possibility that the bubbles may reach the first member can be decreased.

APPLICATION EXAMPLE 12

In the method of manufacturing a liquid container according to Application Example 4, in the process (b), the portion which injects the liquid is positioned in the first partitioned storage chamber. According to the method of manufacturing a liquid container described in Application Example 12, since the liquid is injected from the first partitioned storage chamber which is different from the first member storage chamber in which the first member is disposed, even when bubbles occur at the time of the liquid injection, the possibility that the generated bubbles may reach the first member can be decreased.

APPLICATION EXAMPLE 13

In the method of manufacturing a liquid container according to Application Example 12, in the flow direction of the liquid which circulates from the first partitioned storage chamber to the first member storage chamber through the communication port of the first storage chamber, a channel, which includes the communication port of the first storage chamber at the middle of the channel in the first storage chamber, has the smallest channel cross-sectional area at the communication port of the first storage chamber. According to the method of manufacturing a liquid container described in Application Example 13, the channel, which includes the communication port of the first storage chamber at the middle of the channel, has the smallest channel cross-sectional area at the communication port of the first storage chamber. Thereby, even though bubbles occur when the liquid is injected from the first partitioned storage chamber, the possibility that the bubbles may reach the first member can be further decreased.

APPLICATION EXAMPLE 14

In the method of manufacturing a liquid container according to any one of Application Examples 4 to 13, at least a portion of the plurality of partition walls includes a notch in which the liquid can pass through the end surface. According to the method of manufacturing a liquid container described in Application Example 14, even when bubbles stay in the storage chamber communication port of the first storage chamber and circulation of the liquid between the plurality of partitioned storage chambers through the storage chamber communication port is impeded, the liquid can be circulated between the plurality of partitioned storage chambers through the notch. Thereby, the liquid can be efficiently stored in the liquid storage chamber.

APPLICATION EXAMPLE 15

In the method of manufacturing a liquid container according to any one of Application Examples 4 to 14, the first inner wall includes a notch in which the liquid can pass through the end surface. According to the method of manufacturing a liquid container described in Application Example 15, when the manufactured liquid container is used in a liquid ejecting apparatus, the possibility that the liquid may remain on the first inner wall can be decreased. Here, it is preferable that the notch formed on the first inner wall be provided at a position which comes into contact with one end of the first inner wall or at a position which is close to the one end. Thereby, since the liquid on the inclined first inner wall flows from the other end toward one end, due to the notch, it is possible to prevent the liquid from remaining on the first inner wall.

APPLICATION EXAMPLE 16

In the method of manufacturing a liquid container according to Application Example 1, the liquid storage chamber includes: a first storage chamber in which the first member is disposed; a second storage chamber which is positioned at an upstream side of the first storage chamber based on the flow direction of the fluid; and a liquid communication channel which communicates with the first storage chamber and the second storage chamber, and in the process (b), the portion which injects the liquid is positioned in the liquid communication channel. According to the method of manufacturing a liquid container described in Application Example 16, the liquid can be introduced to the first storage chamber and the second storage chamber through the liquid communication channel at the same timing.

APPLICATION EXAMPLE 17

In the method of manufacturing a liquid container according to Application Example 1, the liquid storage chamber includes: a first storage chamber in which the first member is disposed, a second storage chamber which is positioned at an upstream side of the first storage chamber based on the flow direction of the fluid; and a liquid communication channel which communicates with the first storage chamber and the second storage chamber; and in the process (b), the portion which injects the liquid is positioned in the second storage channel. According to the method of manufacturing a liquid container described in Application Example 17, since the liquid is injected from the second storage chamber different from the first storage chamber in which the first member is disposed, even when bubbles occur at the time of the liquid injection, the possibility that the generated bubbles may reach the first member can be decreased.

APPLICATION EXAMPLE 18

In the method of manufacturing a liquid container according to Application Example 17, in the liquid communication channel, one end opening directly communicates with the second storage chamber, the other end opening directly communicates with the first storage chamber, and a channel, which includes the one end opening at the middle of the channel in the flow direction of the fluid, has the smallest channel cross-sectional area at the one end opening. According to the method of manufacturing a liquid container described in Application Example 18, the channel which includes the one end opening at the middle of the channel has the smallest channel cross-sectional area at the one end opening. Thereby, even though bubbles occur when the liquid is injected from the second storage chamber, the possibility that the bubbles may reach the first member can be decreased.

APPLICATION EXAMPLE 19

In the method of manufacturing a liquid container according to Application Example 1, in the atmosphere introduction channel, a gas-liquid separation film is disposed at the middle of the atmosphere introduction channel, and in the process (b), the portion which injects the liquid is disposed at the downstream side of the gas-liquid separation film in the atmosphere introduction channel in the flow direction of the fluid. According to the method of manufacturing a liquid container described in Application Example 19, the impediment of the flow of the liquid toward the liquid storage chamber does not occur due to the gas-liquid separation film. Thereby, the liquid can be effectively stored in the liquid storage chamber.

APPLICATION EXAMPLE 20

In the method of manufacturing a liquid container according to Application Example 19, in the order from the upstream side to the downstream side in the flow direction of the fluid, the atmosphere introduction channel includes: a first atmosphere introduction channel in which one end is the atmosphere opening port and the gas-liquid separation film is disposed at the middle of the first atmosphere introduction channel; and an air chamber which directly communicates with the first atmosphere introduction channel and in which the upper wall of the liquid container forms the upper surface and a bottom wall opposite to the upper wall in the liquid container forms the bottom surface in a mounting state in which the liquid container is mounted on the liquid ejecting apparatus disposed in a horizontal plane, and in the process (b), the portion which injects the liquid is positioned in the air chamber. According to the method of manufacturing a liquid container described in Application Example 20, the liquid can be injected from the air chamber. Here, in the gas-liquid separation film, if the film is wetted by the liquid, the original function of the gas-liquid separation film may be decreased due to clogging or the like. Here, according to the method of manufacturing a liquid container described in Application Example 20, since the liquid injected from the air chamber is different from the first atmosphere introduction channel in which the gas-liquid separation film is disposed, the possibility that the gas-liquid separation film may be wetted by the liquid at the time of the liquid injection can be decreased. Moreover, since the liquid is injected from the location away from the first member, even though bubbles occur when the liquid is injected, the possibility that bubbles may reach the first member can be decreased.

APPLICATION EXAMPLE 21

In the method of manufacturing a liquid container according to Application Example 20, in the order from the upstream side to the downstream side in the flow direction of the fluid, the air chamber includes: a first air chamber which includes an upper surface formed by the upper wall; and a second air chamber which is partitioned into the first air chamber by a partition wall disposed in the inner portion of the air chamber and includes the bottom surface formed by the bottom wall, the partition wall includes a notch so as to cause the first air chamber and the second air chamber to communicate with each other, and in the process of (b), the portion which injects the liquid is positioned in the first air chamber. According to the method of manufacturing a liquid container described in Application Example 21, even though bubbles occur when the liquid is injected from the first air chamber, the possibility that bubbles may reach the first member can be decreased.

APPLICATION EXAMPLE 22

In the method of manufacturing a liquid container according to Application Example 20, the atmosphere introduction channel includes a second atmosphere introduction channel which is positioned at the downstream side of the air chamber in the flow direction of the fluid, and in the order from the upstream side to the downstream side in the flow direction of the fluid, the air chamber includes: a first air chamber which includes the upper surface formed by the upper wall; and a second air chamber which communicates with the first air chamber, is partitioned into the first air chamber by a partition wall disposed in the inner portion of the air chamber, and includes the bottom surface, the second air chamber includes an air-chamber plate member which includes an air chamber communication hole which causes the second air chamber and the second atmosphere introduction channel to communicate with each other, is disposed so as to interpose the air chamber communication hole along the bottom surface formed by the bottom wall, and extends in a horizontal direction, and in the process (b), the portion which injects the liquid is positioned in the second air chamber. According to the method of manufacturing a liquid container described in Application Example 22, even though bubbles occur when the liquid is injected from the second air chamber, the possibility that the bubbles may penetrate from the second air chamber to the air chamber communication hole can be decreased due to the air-chamber plate member. Thereby, the possibility that the bubbles may reach the first member can be decreased. Here, in the process (b), it is preferable that the portion which injects the liquid be positioned above the air-chamber plate member in the mounting state. Thereby, the possibility that the bubbles may penetrate the air chamber communication hole from the second air chamber can be further decreased due to the air-chamber plate member.

APPLICATION EXAMPLE 23

In the method of manufacturing a liquid container according to Application Example 22, a plurality of the air-chamber plate members are provided, and the plurality of air-chamber plate members are disposed with intervals in a vertical direction in the mounting state. According to the method of manufacturing a liquid container described in Application Example 23, the possibility that the bubbles may penetrate the air chamber communication hole from the second air chamber can be further decreased due to the plurality of air-chamber plate member. Thereby, the possibility that the bubbles may reach the first member can be further decreased.

APPLICATION EXAMPLE 24

In the method of manufacturing a liquid container according to Application Example 20, the atmosphere introduction channel includes a second atmosphere introduction channel which is positioned at a downstream side of the air chamber in the flow direction of the fluid, and in the process (b), the portion which injects the liquid is positioned in the second atmosphere introduction channel. According to the method of manufacturing a liquid container described in Application Example 24, the liquid can be injected from the second atmosphere introduction channel which is positioned at the position away from the first member and at the position close to the liquid storage chamber in the channel from the atmosphere opening port to the supply port. Thereby, the liquid can be effectively stored in the liquid storage chamber, and even though bubbles occur when the liquid is injected, the possibility that the generated bubbles may reach the first member can be decreased.

APPLICATION EXAMPLE 25

In the method of manufacturing a liquid container according to Application Example 24, the second atmosphere introduction channel includes a narrow atmosphere channel which is formed so that a channel cross-sectional area is smaller than the surrounding channel cross-sectional area by a member forming the liquid guiding channel, and in the process (b), the portion which injects the liquid is positioned at the upstream side of the narrow atmosphere channel in the second atmosphere introduction channel in the flow direction of the fluid. According to the method of manufacturing a liquid container described in Application Example 25, since bubbles penetrating the downstream side can be suppressed due to the narrow atmosphere channel, the possibility that the bubbles may reach the first member can be decreased.

APPLICATION EXAMPLE 26

In the method of manufacturing a liquid container according to any one of Application Examples 1 to 25, the process (b) includes a process of forming an injection port for injecting the liquid by making a hole on a formation wall which forms the portion injecting the liquid. According to the method of manufacturing a liquid container described in Application Example 26, the injection port can be easily formed by making a hole on the formation wall. In addition, the liquid can be easily injected to the inner portion of the liquid container through the injection port.

APPLICATION EXAMPLE 27

In the method of manufacturing a liquid container according to Application Example 26, a portion of the formation wall is formed by a film, and the injection port is formed on the film. According to the method of manufacturing a liquid container described in Application Example 27, the injection port can be easily formed on the formation wall.

APPLICATION EXAMPLE 28

In the method of manufacturing a liquid container according to Application Example 26 or 27, the method further includes a process (c) of sealing the injection port after the process (b). According to the method of manufacturing a liquid container described in Application Example 28, the possibility that the liquid inside the liquid container may be leaked to the outside can be decreased by sealing the injection port.

APPLICATION EXAMPLE 29

In the method of manufacturing a liquid container according to any one of Application Examples 1 to 28, the first member is a prism. According to the method of manufacturing a liquid container described in Application Example 29, a liquid residual quantity state of the liquid container can be detected using the prism.

Moreover, the present invention may be realized in various aspects. For example, aspects such as the liquid container and the manufacturing method thereof, a liquid ejecting apparatus which includes the liquid container having any one of the above-described configurations, and a method of injecting liquid to the liquid container can be realized.

DESCRIPTION OF EXEMPLARY EMBODIMENTS

Next, embodiments of the present invention will be described according to the following order.

Figure 1:
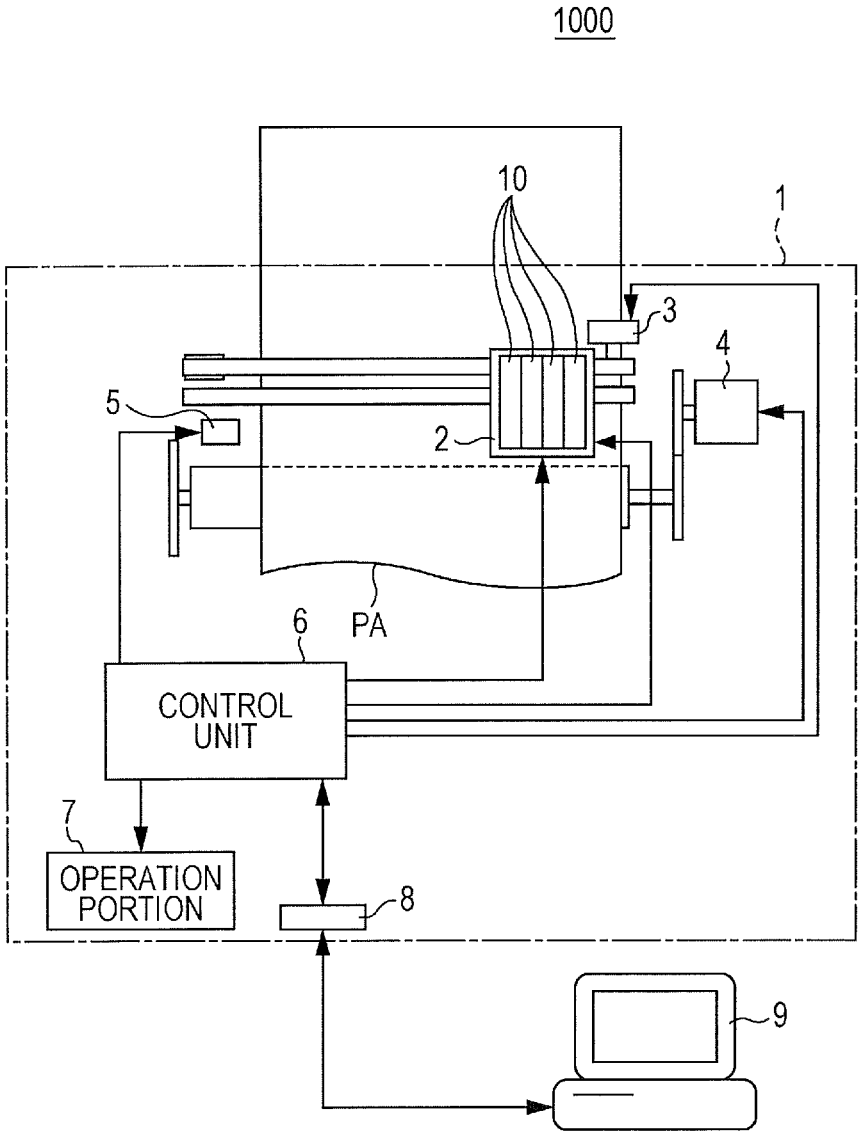
FIG. 1 is a view showing a schematic configuration of a liquid ejecting system 1000.

A. Embodiment:

B. Modification Example:

A. Embodiment:

A-1. Configuration of Liquid Ejecting System:

FIG. 1 is a view showing a schematic configuration of a liquid ejecting system 1000. The liquid ejecting system 1000 includes a liquid container 10 which is an embodiment of the present invention, and a liquid ejecting apparatus 1. The liquid ejecting apparatus 1 is an ink jet printer 1 (hereinafter, simply referred to as a "printer 1") which discharges ink on a printing paper PA and performs printing. The printer 1 includes the ink cartridge 10 which is a liquid container, a holder 2, a first motor 3, a second motor 4, a control unit 6, an operation portion 7, a predetermined interface 8, and an optical detection device 5. Moreover, in descriptions below, the ink cartridge 10 is simply referred to as a "cartridge 10".

The holder 2 includes a print head (not shown) which discharges ink to a side opposite to the printing paper PA. Moreover, the cartridge 10 is mounted so as to be attached to and detached from the holder 2. Ink such as cyan, magenta, or yellow is stored in each cartridge 10 respectively. The ink which is stored in the cartridge 10 is supplied to the print head of the holder 2, and the ink is discharged to the printing paper PA.

The first motor 3 drives the holder 2 in a main scanning direction. The second motor 4 transports the printing paper PA in a sub scanning direction. The control unit 6 controls the overall operation of the printer 1.

The optical detection device 5 is fixed at a predetermined position. When the holder 2 moves to a predetermined position, the optical detection device 5 radiates light toward the cartridge 10 in order to detect the ink residual quantity state. Moreover, the details will be described below.

The control unit 6 controls the first motor 3, the second motor 4, and the print head based on the print data which is received from a computer 9 or the like connected through the predetermined interface 8 and performs printing. Moreover, the control unit 6 detects the ink residual quantity state (the ink residual quantity, or presence or absence of the ink) of the cartridge 10 based on the data which is received from the optical detection device 5. The operation portion 7 is connected to the control unit 6 and receives various operations from a user.

Figure 2:
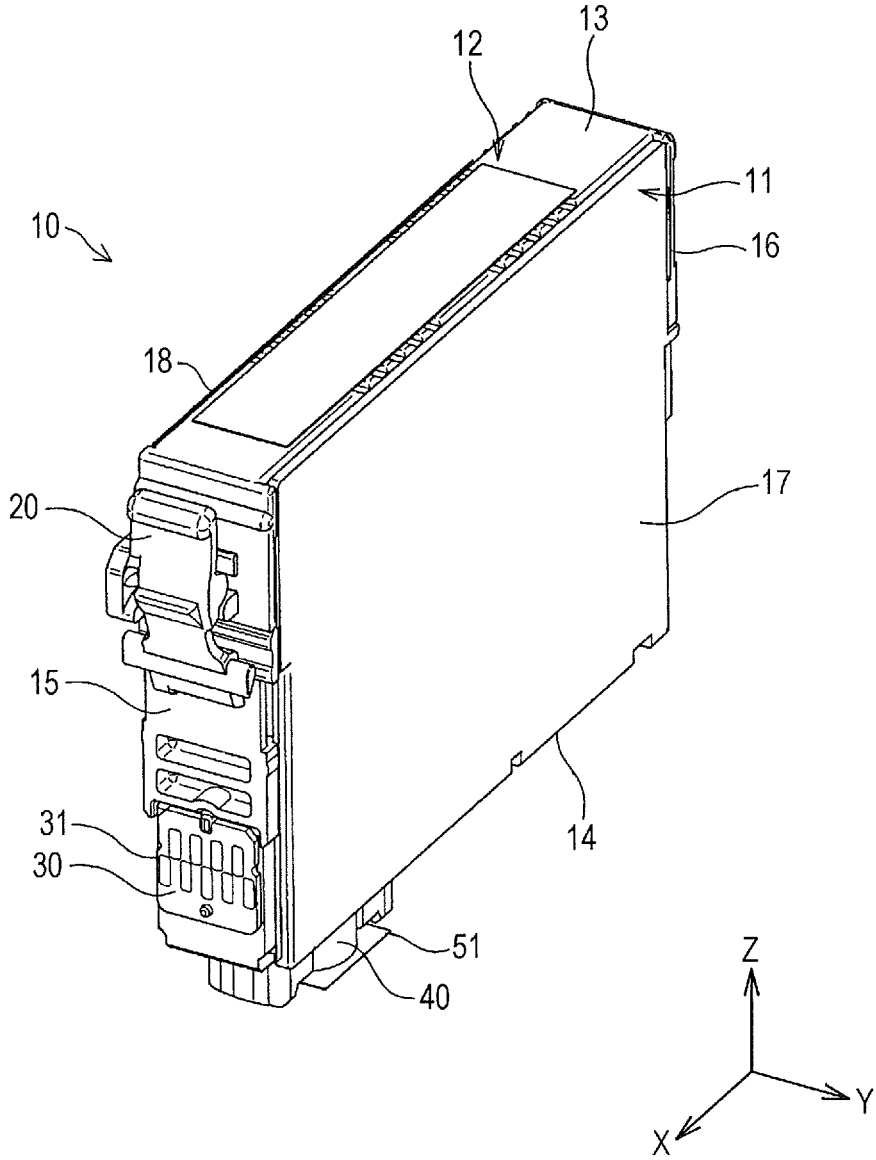
FIG. 2 is a first appearance perspective view of a cartridge 10.
Figure 3:
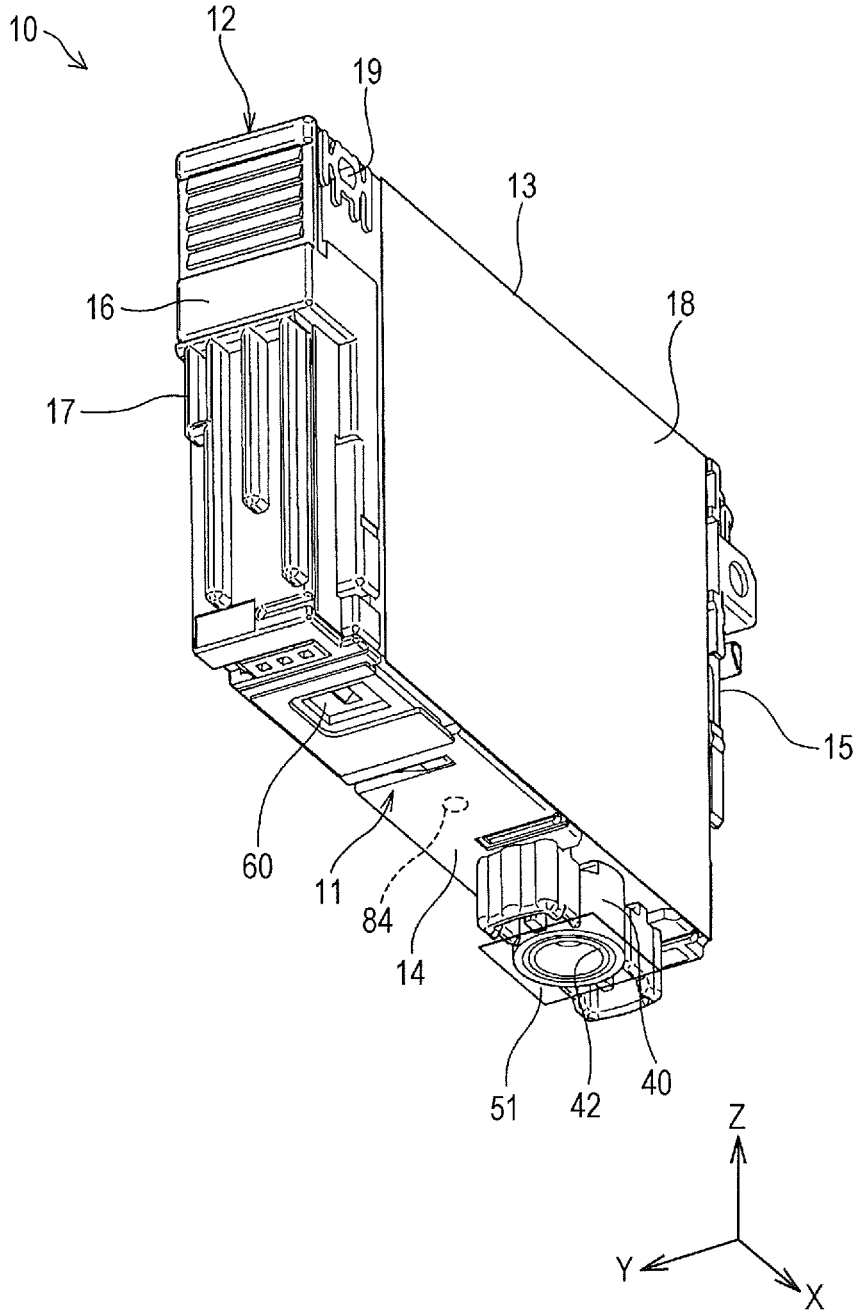
FIG. 3 is a second appearance perspective view of the cartridge 10.

A-2. Schematic Configuration of Cartridge:

FIG. 2 is a first appearance perspective view of a cartridge 10. FIG. 3 is a second appearance perspective view of the cartridge 10. In FIGS. 2 and 3, XYZ axes which are coordinate axes perpendicular to each other are attached. In addition, also in the drawings shown below, XYZ axes are attached if necessary. In a mounting state (mounting posture) in which the cartridge 10 is mounted on the printer 1 disposed on a horizontal plane, a Z axis negative direction is referred to as a vertically downward direction. Moreover, the horizontal plane is a plane which is parallel to the X axis direction and the Y axis direction.

As shown in FIGS. 2 and 3, an appearance shape of the cartridge 10 is an approximately rectangular shape. The outer surface (outer shell) of the cartridge 10 includes six surfaces. The six surfaces includes a bottom surface 14, an upper surface 13, a front surface 15, a rear surface 16, a right surface 17, and a left surface 18. The six surfaces 13 to 18 may also be referred to as outer shell members which configure the outer shell of the cartridge 10. Each of the surfaces 13 to 18 is a planar shape. The planar shape includes a case where the entire area is completely planar and a case where unevenness is provided on a portion of the surface. That is, some unevenness may be provided on a portion of the surface. The outer shapes of each of the surfaces 13 to 18 in a plan view all are rectangular. The outer surface (outer shell) of the cartridge 10 includes a film (described below) which forms a portion of the left surface 18, a container main body 12, and a cover member 11.

Moreover, the bottom surface 14 is a concept which includes a wall forming a bottom wall of the cartridge 10 in the mounting state, and may also be referred to as a "bottom surface wall portion (bottom wall) 14". In addition, the upper surface 13 is a concept which includes a wall forming an upper wall of the cartridge 10 in the mounting state, and may also be referred to as a "upper surface wall portion (upper wall) 13". Moreover, the front surface 15 is a concept which includes a wall forming a front wall of the cartridge 10 in the mounting state, and may also be referred to as a "front surface wall portion (front wall) 15". In addition, the rear surface 16 is a concept which includes a wall forming a rear wall in the mounting state, and may also be referred to as a "rear surface wall portion (rear wall) 16". Moreover, the right surface 17 is a concept which includes a wall forming a right wall in the mounting state, and may also be referred to as a "right surface wall portion (right wall) 17". In addition, the left surface 18 is a concept which includes a wall forming a left wall in the mounting state, and may also be referred to as a "left surface wall portion (left wall) 18". Moreover, the "wall portion" or the "wall" is not needed to be formed by a single wall, and may be formed by a plurality of walls. For example, the bottom surface wall portion (bottom wall) 14 is a wall which is positioned in the Z axis negative direction side with respect to the inner space of the cartridge 10 in the mounting state. In other words, as shown in FIG. 3, the bottom surface wall portion (bottom wall) 14 is formed by the cover member 11, the container main body 12, the first member unit 60, or the like.

The bottom surface 14 and the upper surface 13 are opposite to each other. The front surface 15 and the rear surface 16 are opposite to each other. The right surface 17 and the left surface 18 are opposite to each other. Specifically, the bottom surface 14 and the upper surface 13 are opposite to each other in the Z axis direction, the front surface 15 and the rear surface 16 are opposite to each other in the X axis direction, and the right surface 17 and the left surface 18 are opposite to each other in the Y axis direction. Here, the bottom surface 14 is also referred to as a first surface 14. The rear surface 16 is also referred to as a second surface 16. The front surface 15 is also referred to as a third surface 15. The upper surface 13 is also referred to as a fourth surface 13. The right surface 17 is also referred to as a fifth surface 17. The left surface 18 is also referred to as a sixth surface 18.

In the length (the length in the X axis direction), the width (the length in the Y axis direction), and the height (the length in the Z axis direction) of the cartridge 10, the sizes becomes small in the order of the length, the height, and the width. Moreover, the size relationships in the length, the width, and the height of the cartridge 10 can be appropriately changed, and for example, the sizes may be small in the order to the height, the length, and the width, and the height, the length, and the width may be the same as one another.

As shown in FIG. 3, a liquid supply portion 40 is disposed so as to protrude on the bottom surface 14. The liquid supply portion 40 is an approximately cylindrical shape. The bottom surface 14 is a horizontal surface in the mounting state. A liquid supply needle which is provided in the holder 2 and is to circulate ink to the print head is inserted into the liquid supply portion 40. A supply port 42 for circulating the ink inside the cartridge 10 toward the outside is formed on the end surface of the liquid supply portion 40. The liquid supply needle is inserted into the supply port 42, and thus, the cartridge 10 is connected to the holder 2. In the cartridge 10 before the cartridge is mounted on the printer 1, the supply port 42 is blocked by a film 51. The film 51 is configured so as to be broken by the liquid supply needle. In the bottom surface 14, the first member unit 60 is positioned at a position which is nearer to the rear surface 16 than the front surface 15. In other words, the first member unit 60 is positioned on the rear surface 16 side rather than the position, in which the liquid supply portion 40 is positioned, in the bottom surface 14. The first member unit 60 is used for the detection of the liquid residual quantity state of the cartridge 10 using the detection device 5.

The first member unit 60 is transparent. The first member unit 60 is disposed so as to view a liquid storage chamber 120 described below from the outside of the cartridge 10. Moreover, the first member unit 60 may be translucent. The details of the first member unit 60 will be described below.

The front surface 15 crosses the bottom surface 14. Moreover, the front surface 15 crosses the upper surface 13. As shown in FIG. 2, in the front surface 15, a circuit substrate 30 is provided in a position which is closer to the bottom surface 14 than the upper surface 13. A plurality of substrate terminals 31 are formed on the surface of the circuit substrate 30. Each of the plurality of substrate terminals 31 comes into contact with the corresponding terminal of a plurality of device side terminals which are provided in the holder 2, in the mounting state. Thereby, the circuit substrate 30 is electrically connected to the control unit 6 of the printer 1. Moreover, a rewritable memory is provided on the rear surface of the circuit substrate 30. Information with respect to the cartridge 10 such as ink consumption or ink color of the cartridge 10 is recorded in the memory. Moreover, in the front surface 15, a lever 20 is provided in a position which is closer to the upper surface 13 than the circuit substrate 30. The lever 20 is elastically deformed and is used for attachment and detachment of the cartridge 10 with respect to the printer 1.

Figure 4:
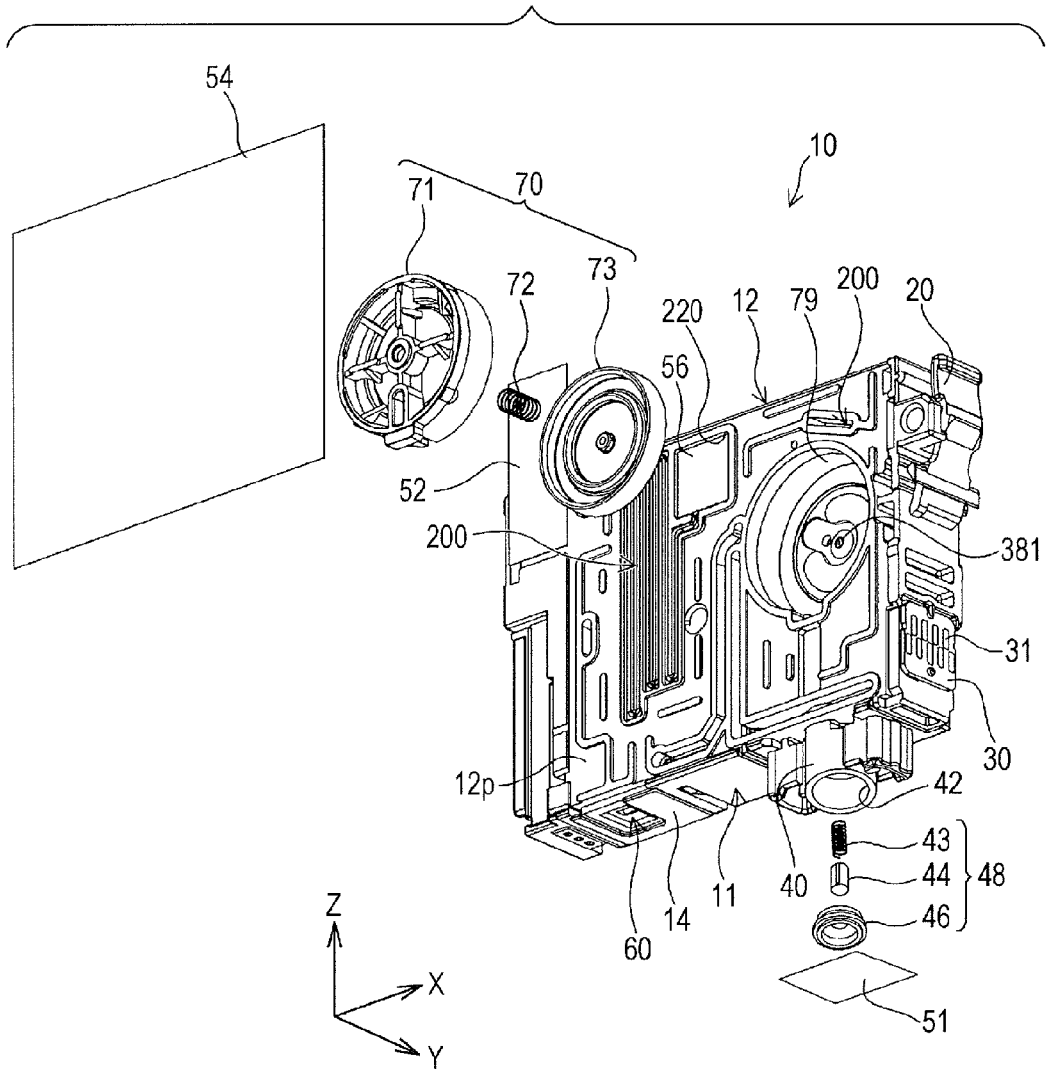
FIG. 4 is a partially exploded perspective view of the cartridge 10.

As shown in FIG. 3, an atmosphere opening port 19 is formed on the left surface 18. The atmosphere opening port 19 is an opening for introducing air to the inner portion of the cartridge 10. In the cartridge 10 before use and after the ink is stored, a film 52 is stuck so as to seal the atmosphere opening port 19 (FIG. 4). When the cartridge 10 is used, after a user peels the film 52, the user mounts the cartridge 10 to the holder 2.

Here, the directions of the cartridge 10 may be defined as follows using XYZ axes which are coordinate axes perpendicular to each other. That is, the direction in which the bottom surface 14 and the front surface 13 are opposite to each other is a Z axis direction. In addition, in the Z axis direction, the direction from the bottom surface 14 toward the upper surface 13 is a Z axis positive direction. Moreover, in the Z axis direction, the direction from the upper surface 13 toward the bottom surface 14 is a Z axis negative direction. In addition, the direction in which the front surface 15 and the rear surface 16 are opposite to each other is an X axis direction. In addition, in the X axis direction, the direction from the rear surface 16 toward the front surface 15 is an X axis positive direction. Moreover, in the X axis direction, the direction from the front surface 15 toward the rear surface 16 is an X axis negative direction. In addition, the direction in which the right surface 17 and the left surface 18 are opposite to each other is a Y axis direction. Moreover, in the Y axis direction, the direction from the left surface 18 toward the right surface 17 is a Y axis positive direction. In addition, in the Y axis direction, the direction from the right surface 17 toward the left surface 18 is a Y axis negative direction.

Moreover, the directions of the cartridge 10 may be defined as follows using XYZ axes which are coordinate axes perpendicular to each other. That is, the direction in which the liquid supply portion 40 extends is the Z axis direction. In the Z axis direction, in the flow direction of the fluid, the direction from the upstream side toward the downstream side is the Z axis negative direction. Moreover, in the Z axis direction, in the flow direction of the fluid, the direction from the downstream side toward the upstream side is the Z axis positive direction. In addition, the movement direction when the cartridge 10 is attached to and detached from the holder 2 may be referred to as the Z axis direction. In the Z axis direction, the movement direction when the cartridge 10 is mounted on the holder 2 is the Z axis negative direction. Moreover, in the Z axis direction, the movement direction when the cartridge 10 is removed from the holder 2 is the Z axis positive direction. In addition, the direction, in which the cartridge 10 mounted on the holder 2 moves in the main scanning direction by the driving of the first motor 3 (FIG. 1), is the Y axis direction.

Moreover, the length direction of the cartridge 10 may be referred to as the X axis direction, the width direction may be referred to as the Y axis direction, and the height direction may be referred to as the Z axis direction.

Figure 5A:
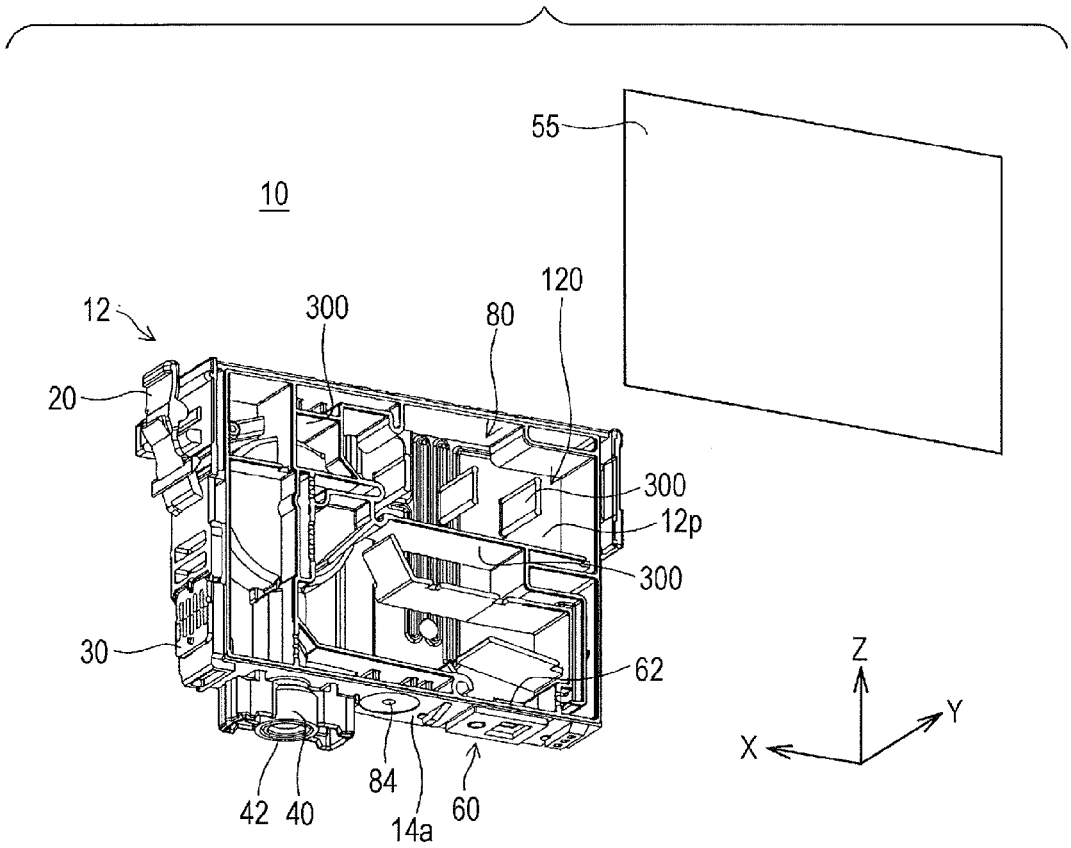
FIG. 5A is a perspective view of a container main body 12.

FIG. 4 is a partially exploded perspective view of the cartridge 10. FIG. 5A is a perspective view of the container main body 12. FIG. 4 shows a state where the cover member 11 is mounted to the container main body 12. FIG. 5A shows a state where the cover member 11 is not mounted to the container main body 12.

As shown in FIG. 5A, the container main body 12 is a concave shape. Plate-like walls 300 (ribs 300) having various shapes are formed in a first side of a wall 12*p* which forms the bottom portion of the container main body 12 having a concave shape. In other words, plate-like walls 300 (ribs 300) having various shapes are formed in the Y axis positive direction side of the container main body 12. A film 55 is closely stuck to the end surfaces of the Y axis positive direction sides of the ribs 300. A plurality of small chambers such as the liquid storage chamber 120 described below are formed so as to be partitioned in the inner portion of the cartridge 10 by the ribs 300 and the film 55. That is, the wall 12*p* may form one wall surface of a plurality of outer wall surfaces of the liquid storage chamber 120. The wall 12*p* is a flat plate shape. Each of the chambers will be described in more detail below. Moreover, the cover member 11 shown in FIG. 2 is mounted to the container main body 12 so as to cover the film 55. The cover member 11 also covers a portion of the surface on which the liquid supply portion 40 of the container main body 12 is provided, and thus, also forms a portion of the bottom surface 14 (FIG. 4). For example, each of the container main body 12 and the cover member 11 can be prepared by integrally molding synthetic resins such as polyethylene, polystyrene, or polypropylene.

As shown in FIG. 4, a plurality of grooves 200 are formed in the Y axis negative direction side of the wall 12*p* . That is, the plurality of grooves 200 are formed in the Y axis negative direction side of the container main body 12. Moreover, a valve chamber 79 in which a valve unit 70 is disposed and a gas-liquid separation chamber 220 in which a gas-liquid separation film 56 is disposed are formed in the Y axis negative direction side of the container main body 12. Each of the valve 79 and the gas-liquid separation chamber 220 is a concave portion which is formed in the Y axis negative direction side of the wall 12*p*. A valve hole 381 is formed on the bottom portion of the valve chamber 79. The gas-liquid separation film 56 is configured of a material which permits transmission of gas and does not permit transmission of liquid.

The valve unit 70 includes a valve member 73, a spring 72, and a spring seat 71. In the flow direction of the fluid from the atmosphere opening port 19 to the supply port 42, the valve member 73 is deformed based on pressure differences of the channel in which the valve member 73 is interposed, and thus, the valve unit 70 opens and closes the valve hole 381. The spring 72 biases the valve member 73 in a direction in which the valve member 73 presses the valve hole 381. By the valve member 73, the pressure of the downstream side (also referred to as a "valve downstream side") of the valve chamber 79 is adjusted so as to be lower than the pressure of the upstream side (also referred to as a "valve upstream side") of the valve chamber 79, and the valve downstream side becomes a negative pressure based on the atmospheric pressure. If the cartridge 10 is mounted on the printer 1 and the ink of the valve downstream side is consumed, the absolute value of the negative pressure of the valve downstream side is increased, and the valve member 73 is deformed so as to be away from the valve hole 381. Accordingly, the ink of the liquid storage chamber 120 is supplied to the downstream side of the valve chamber 79, and the valve downstream side is returned to a predetermined range of negative pressure. Thereby, the valve member 73 is deformed so as to block the valve hole 381 by the force of the spring 72. Moreover, according as consumption of the ink of the liquid storage chamber 120, the atmosphere (air) is introduced into the liquid storage chamber 120 through the atmosphere opening port 19.

As shown in FIG. 4, the cartridge 10 includes a film 54. The film 54 is stuck to the container main body 12 so as to cover a portion, in which at least the groove 200, the gas-liquid separation chamber 220, or the valve chamber 79 is formed, in the Y axis negative direction side of the container main body 12. By the film 54 and the container main body 12, various channels described below, for example, a channel through which the ink or the atmosphere circulates is formed.

As shown in FIG. 4, a supply unit 48 is disposed in the inner portion of the liquid supply portion 40. The supply unit 48 includes a seal member 46, a spring seat 44, and a spring 43 in the above order from the supply port 42 of the liquid supply portion 40. The seal member 46 seals so that a gap is not generated between the inner wall of the liquid supply portion 40 and the outer wall of the liquid supply needle when the liquid supply needle of the printer 1 is inserted into the liquid supply portion 40. The spring seat 44 abuts the seal member 46 when the cartridge 10 is not mounted on the holder 2, and occludes the channel in the liquid supply portion 40. The spring 33 biases the spring seat 44 in the direction in which the spring seat 44 abuts the seal member 46. If the liquid supply needle is inserted into the liquid supply portion 40, the liquid supply needle pushes the spring seat 44 up in the Z axis positive direction, a gap is generated between the spring seat 44 and the seal member 46, and ink is supplied to the liquid supply needle from the gap.

As shown in FIG. 5A, a decompression hole 84 is formed on a wall 14*a* of the container main body 12 on which the liquid supply portion 40 is provided. The compression hole 84 may be used to decompress the inner portion of the cartridge 10 by sucking the air of the inner portion when ink is injected in a manufacturing process of the cartridge 10. Moreover, the first member unit 60 is mounted on the wall 14*a* . The first member unit 60 includes a surface 62 which is positioned in the inner portion of the cartridge 10.

Figure 5B:
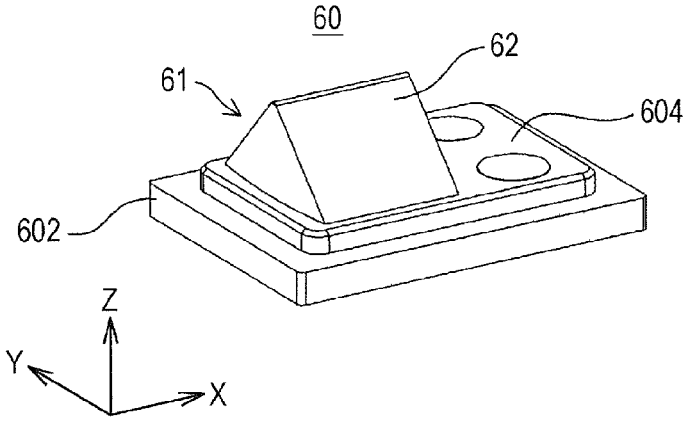
FIG. 5B is an appearance perspective view of a first member unit 60.
Figure 5C:
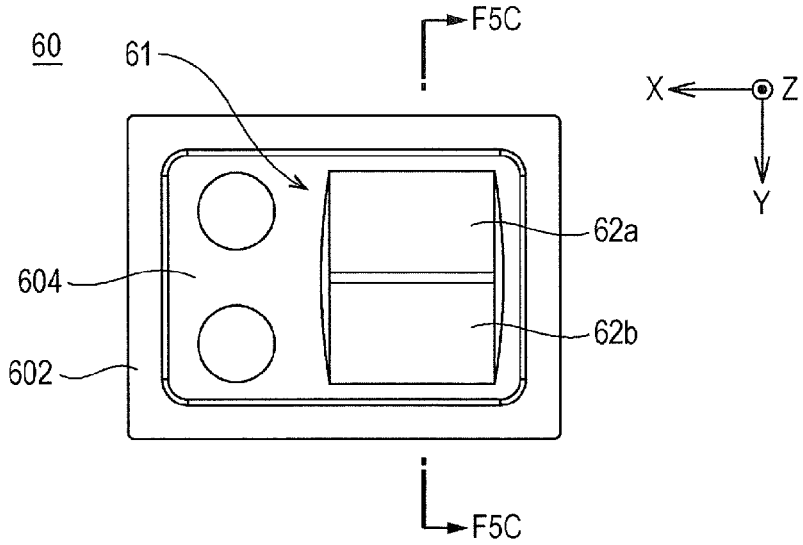
FIG. 5C is a top view of the first member unit 60.
Figure 5D:
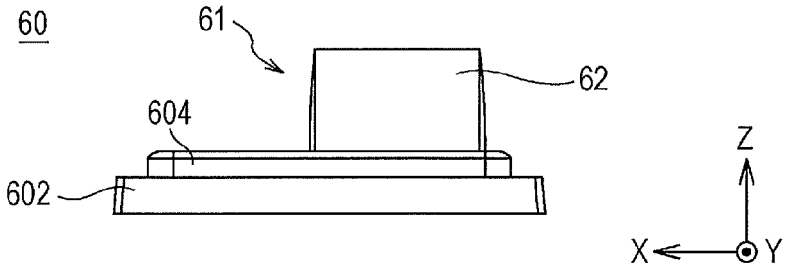
FIG. 5D is a right side view of the first member unit 60.
Figure 5E:
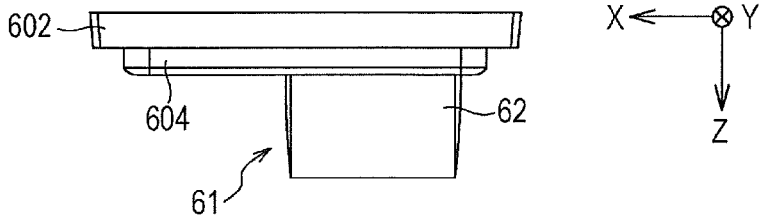
FIG. 5E is a left side view of the first member unit 60.
Figure 5F:
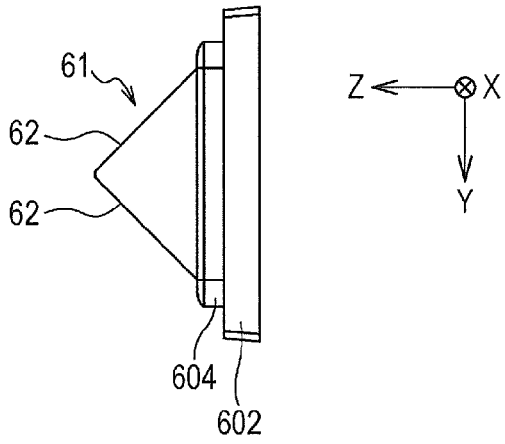
FIG. 5F is a rear view of the first member unit 60.
Figure 5G:
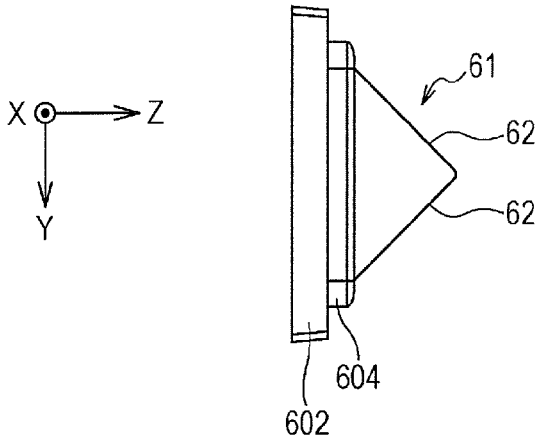
FIG. 5G is a front view of the first member unit 60.
Figure 5H:
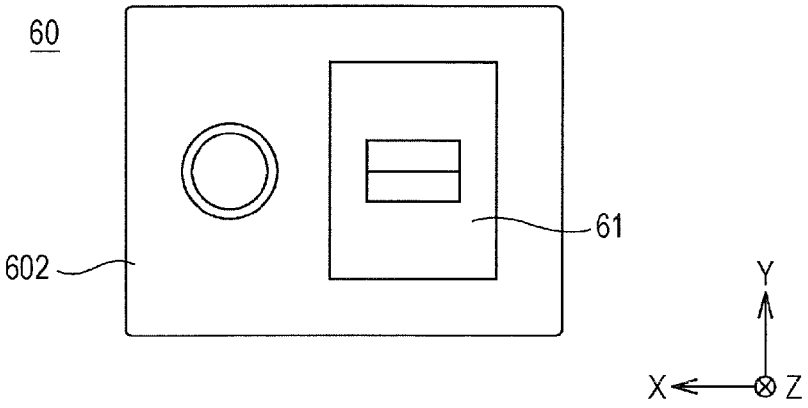
FIG. 5H is a bottom view of the first member unit 60.
Figure 5I:
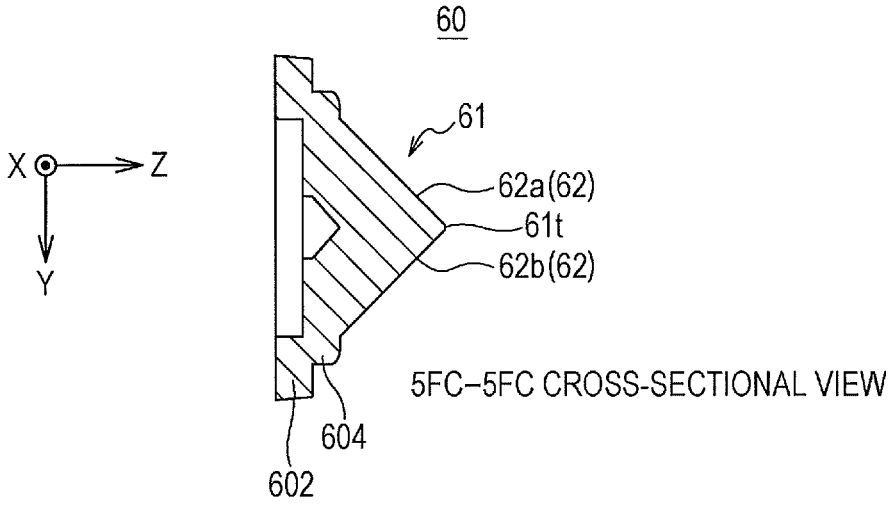
FIG. 5I is a cross-sectional view taken along F5C-F5C of FIG. 5C.

FIG. 5B is an appearance perspective view of the first member unit 60. FIG. 5C is a top view of the first member unit 60. FIG. 5D is a right side view of the first member unit 60. FIG. 5E is a left side view of the first member unit 60. FIG. 5F is a rear view of the first member unit 60. FIG. 5G is a front view of the first member unit 60. FIG. 5H is a bottom view of the first member unit 60. FIG. 5I is a cross-sectional view taken along F5C-F5C of FIG. 5C.

As shown in FIGS. 5B to 5I, the first member unit 60 includes a prism 61 which is a first member. The prism 61 is a triangular prism and a so-called triangular prismatic shape. In addition, the prism 61 is a rectangular prism. The prism 61 includes two surfaces 62 (first surface 62*a* and second surface 62*b* ) which are inclined in the same angle with respect to the horizontal plane in the mounting state. The first member unit 60 is disposed on the bottom surface 14 so that two surfaces 62 are positioned in the liquid storage chamber 120. As shown in FIG. 5I, the prism 61 includes a ridgeline 61*t* which forms a vertical angle due to the fact that the first surface 62*a* and the second surface 62*b* cross each other. When the first surface 62*a* and the second surface 62*b* actually cross each other, the ridgeline 61*t* is a line in which the first surface and the second surface actually cross each other and are formed. Moreover, when the first surface 62*a* and the second surface 62*b* do not actually cross each other, the ridgeline 61*t* is a line in which the plane including the first surface 62*a* and the plane including the second surface 62*b* cross each other and are formed.

Moreover, the first member unit 60 includes an attaching portion 602 and a base portion 604. The attaching portion 602 forms a portion of the bottom surface 14 (FIG. 4). The base portion 604 is disposed on the attaching portion 602. In the base portion 604, the surface, on which the prism 61 is disposed, is exposed to the inner portion of the liquid storage chamber 120 and forms a portion of a first member disposition surface described below. The prism 61 is disposed on the base portion 604.

Figure 6:
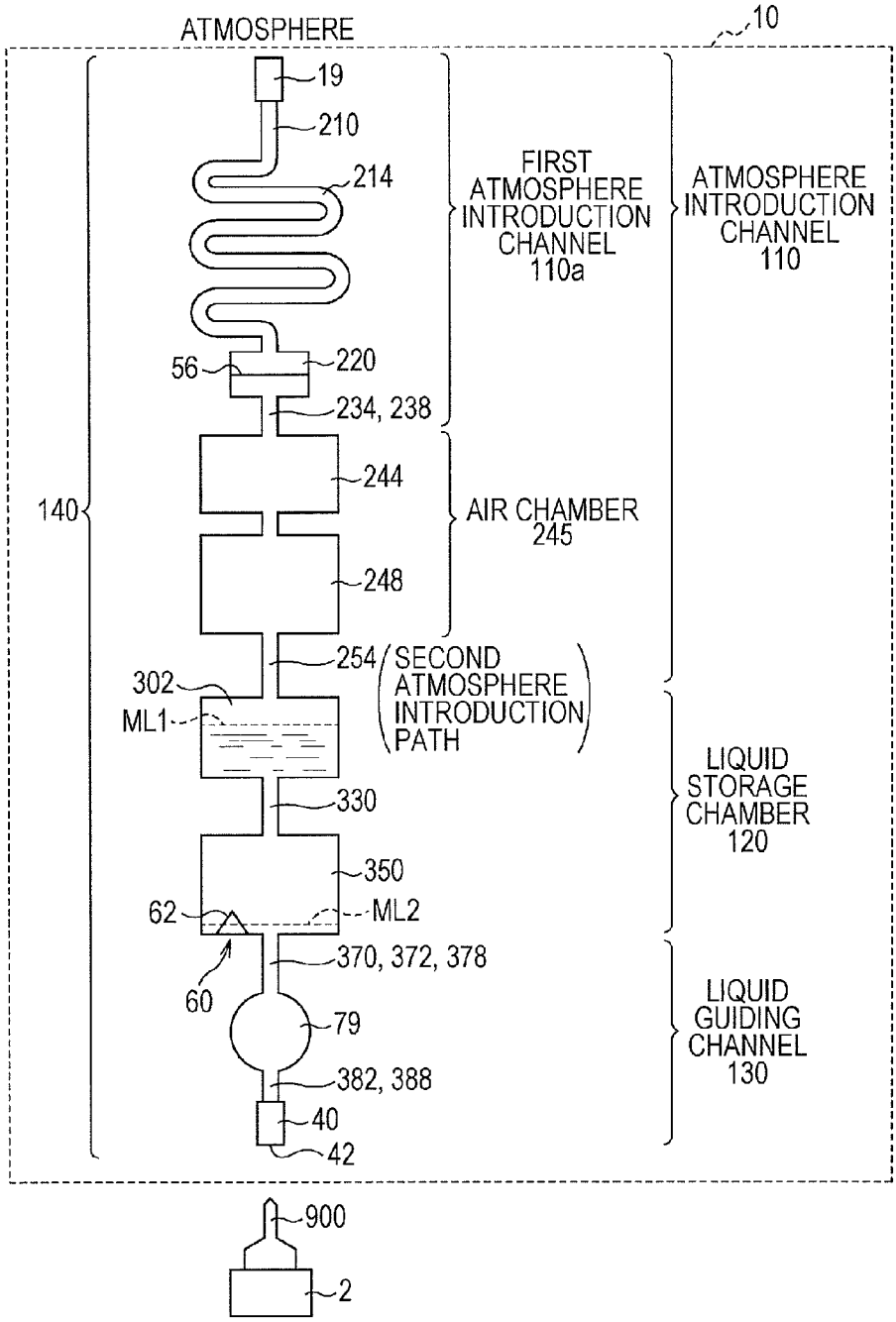
FIG. 6 is a view for conceptually illustrating a channel 140.

FIG. 6 is a view for conceptually illustrating a channel 140 from the atmosphere opening port 19 to the supply port 42. Before the inner structure of the cartridge 10 is described, for easy understanding, the channel 140 from the atmosphere opening port 19 to the support port 42 will be described with reference to FIG. 6. Moreover, when each channel which configures the channel 140 is described, the references of the "upstream side" and the "downstream side" are based on the flow direction of the fluid from the atmosphere opening port 19 toward the supply port 42.

The channel 140 is largely divided into the liquid storage chamber 120 for storing ink, an atmosphere introduction channel 110 which is disposed at the upstream side of the liquid storage chamber 120, and a liquid guiding channel 130 which is disposed at the downstream side of the liquid storage chamber 120. The atmosphere introduction channel 110 is a channel for circulating atmosphere (air), which is taken into the inner portion through the atmosphere opening port 19 from the outside, to the liquid storage chamber 120. The liquid guiding channel 130 is a channel for circulating the ink, which is stored in the liquid storage chamber 120, to the printer 1 through the supply portion 42. As described above, the channel 140 is formed by the container main body 12 and two films 54 and 55 (FIGS. 4 and 5A). The two films 54 and 55 are disposed in positions between which the container main body 12 is interposed.

The atmosphere introduction channel 110 includes a first atmosphere channel 210, a meandering channel 214, a gas-liquid separation chamber 220, a second atmosphere channel 234, a third atmosphere channel 238, an air chamber 245, and a third atmosphere channel 254 in the above order from the upstream side. The meandering channel 214 is formed so as to be slenderly meandered for lengthening the channel length from the atmosphere opening port 19 to the liquid storage chamber 120. Thereby, evaporation of the moisture in the ink in the liquid storage chamber 120 can be suppressed. A gas-liquid separation film 56 is disposed at the middle of the gas-liquid separation chamber 220 so as to partition the channel. Due to the gas-liquid separation film 56, even when the ink reversely flows from the liquid storage chamber 120 to the upstream side, it is possible to suppress the ink from penetrating the upstream of the gas-liquid separation film 56. The air chamber 245 includes a first air chamber 244 and a second air chamber 248 in the above order from the upstream side. When the air in the liquid storage chamber 120 expands due to a temperature increase or like, and the ink in the liquid storage chamber 120 reversely flows in the air chamber 245 through the third atmosphere channel 254, the air chamber 245 catches the ink, which reversely flows, at the air chamber 120, and prevents the ink reversely flowing from being leaked from the atmosphere opening port 19. Moreover, in the plurality of air chambers, the volume of the second air chamber 248 close to the liquid storage chamber 120 is larger than the volume of the first air chamber 244. Thereby, even when the ink reversely flows, the ink can be trapped at the further downstream side (a side far from the outer portion of the liquid storage chamber 120).

In the atmosphere introduction channel 110, the channel which is positioned at the upstream side of the air chamber 245 is also referred to as a first atmosphere introduction channel 110*a* , and the third atmosphere channel 254, which is a channel positioned at the downstream side of the air chamber 245, is also referred to as a second atmosphere introduction channel 254.

The liquid storage chamber 120 includes a second storage chamber 302, a liquid communication channel 330, and a first storage chamber 350 in the above order from the upstream side. The liquid communication channel 330 causes the second storage chamber 302 and the first storage chamber 350 to communicate with other.

The liquid guiding channel 130 includes a narrow channel (first through channel) 370, a first liquid channel 372, a second liquid channel 378, a valve chamber 79, a first vertical channel 382, a supply channel 388, and the liquid supply portion 40 in the above order from the upstream side. A liquid supply needle 900 of the holder 2 is inserted into the liquid supply portion 40.

For example, at the time of manufacturing the cartridge 10, the ink is filled up to the second storage chamber 302 as the liquid surface is conceptually shown by a dotted line ML1 in FIG. 6. If the ink in the inner portion of the cartridge 10 is consumed by the printer 1, the liquid surface moves to the downstream side, and the atmosphere flows into the inner portion of the cartridge 10 from the upstream side through the atmosphere opening port 19 instead. In addition, if the consumption of the ink progresses, as the liquid surface is conceptually shown by a dotted line ML2 in FIG. 6, the liquid surface is positioned below a predetermined portion of the surface 62 of the first member 61. Accordingly, the control unit 6 detects that the ink residual quantity of the cartridge 10 is decreased, using the optical detection device 5. Moreover, at a step before the ink of the inner portion of the cartridge 10 is completely consumed, the control unit 6 stops the printing and informs of an ink shortage to a user. If the ink is completely consumed and the printing is further performed, air is mixed into the printer head, and there is a concern that disadvantages may occur.

Figure 7:
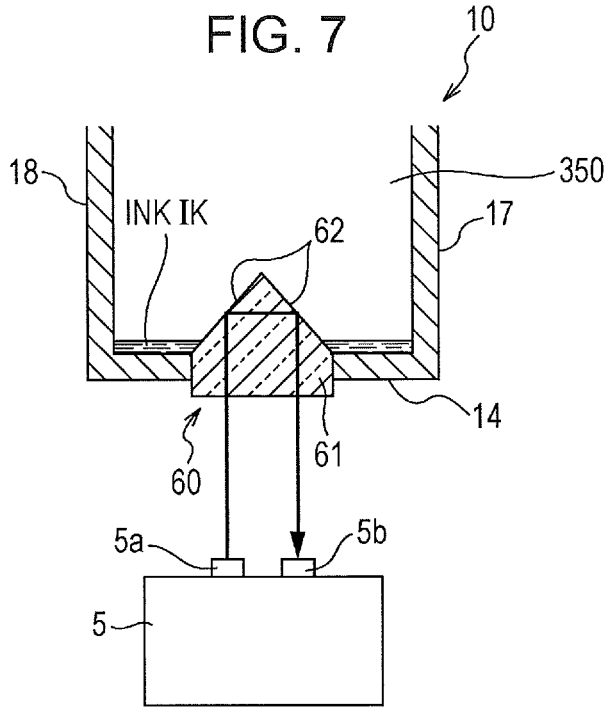
FIG. 7 is a first view for illustrating a method of detecting an ink residual quantity state.
Figure 8:
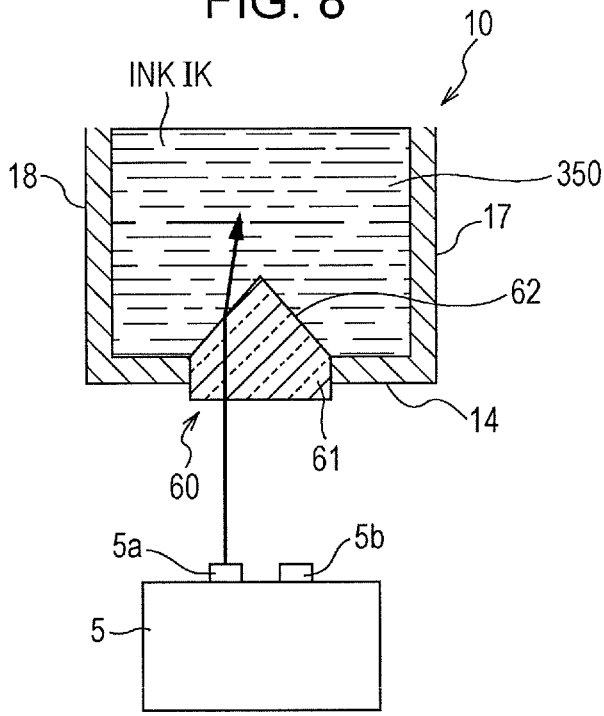
FIG. 8 is a second view for illustrating the method of detecting the ink residual quantity state.

A-3. Detection of Residual Quantity using First Member Unit:

FIG. 7 is a first view for illustrating a method of detecting the ink residual quantity state. FIG. 8 is a second view for illustrating the method of detecting the ink residual quantity state. FIGS. 7 and 8 are schematic cross-sectional views of a portion of the first storage chamber 350 in which first member unit 60 is disposed.

The optical detection device 5 includes a light-emitting element 5*a* which emits light toward the first member unit 60 and a light-receiving element 5*b* for receiving light which is reflected from the first member unit 60.

In the surface 62 of the prism 61, the reflection state of the light is changed according to the refractive index of the fluid with which the surface comes into contact. As shown in FIG.

7, in the surface 62, in a first case where the portion to which the light is radiated comes into contact with air, due to the difference of the refractive indexes between the prism 61 and the air, the light, which is emitted from the light-emitting element 5*a* toward the surface 62, is reflected at the surface 62, and is incident to the light-receiving element 5*b* . On the other hand, as shown in FIG. 8, in the surface 62, in a second case where the portion to which the light is radiated comes into contact with the ink, since the refractive indexes between the prism 61 and the ink are approximately the same as each other, the light which is emitted from the light-emitting element 5*a* is slightly refracted at the surface 62, and advances inside the ink. That is, by measuring the light which is incident to the light-receiving element 5*b* , the ink residual quantity state can be detected. In other words, when the ink of the liquid storage chamber 120 is decreased to the extent in which a portion of the surface 62 comes into contact with air, the light is incident to the light-receiving element 5*b*. On the other hand, when the ink in the liquid storage chamber 120 is sufficiently stored to the extent in which the ink is positioned above the portion of the surface 62 to which the light is radiated, the light is not almost incident to the light-receiving element 5*b*.

In this way, the first member (prism) 61 may also be referred to a member which is used for optically detecting the ink residual quantity or presence or absence of the ink in the cartridge 10. Here, the optically detecting may use a light reflection type sensor which is generally used or a light transmission type sensor. Moreover, the sensor itself may be provided in the printer 1 side or be integrally formed with the cartridge 10.

A-4. Detail Configuration of Cartridge

Figure 9:
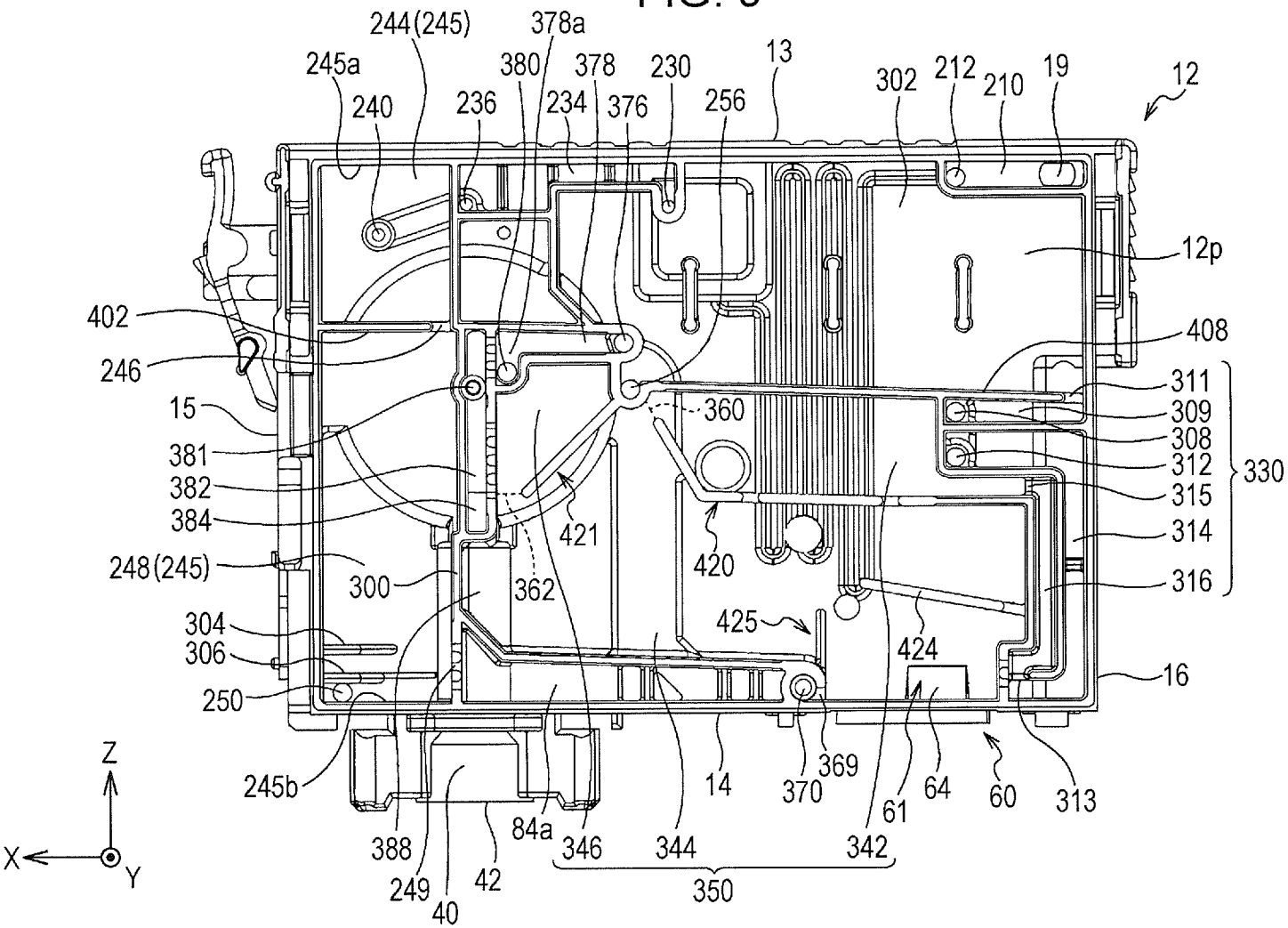
FIG. 9 is a view when the container main body 12 is viewed from a Y axis positive direction side (a first side).
Figure 10:
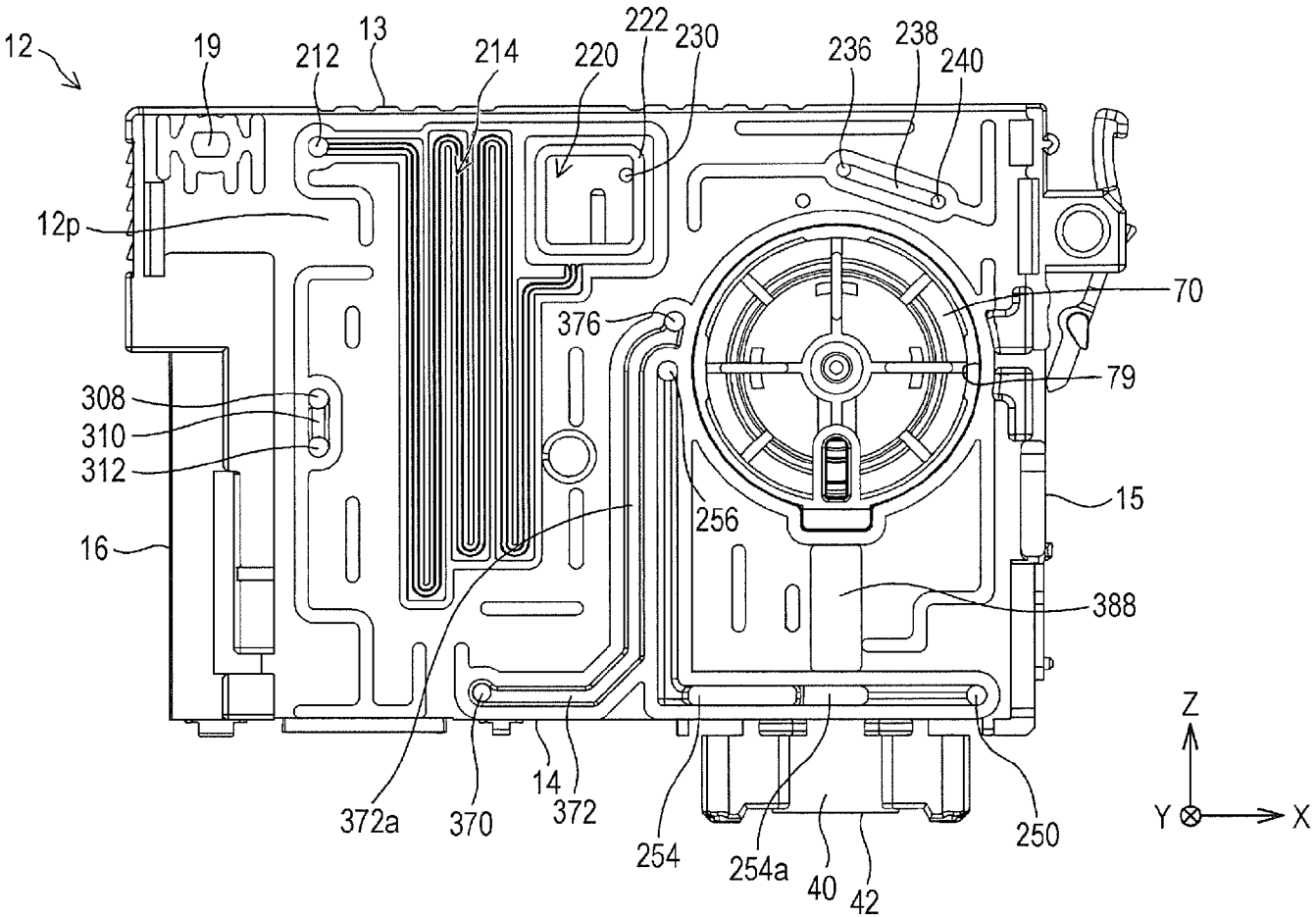
FIG. 10 is a view when the container main body 12 is viewed from a Y axis negative direction side (a second side).
Figure 11:
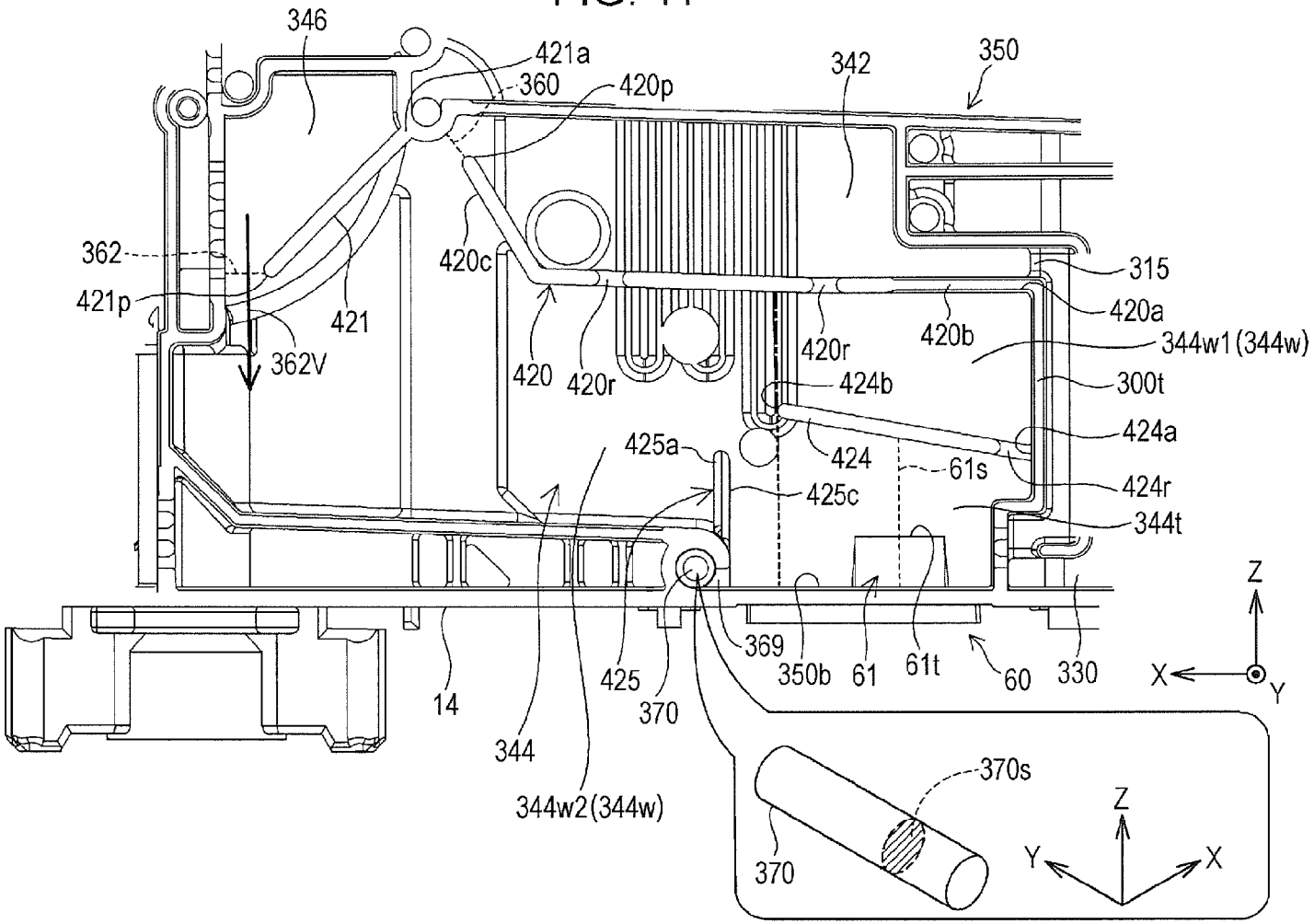
FIG. 11 is an enlarged view of a first storage chamber 350 shown in FIG. 9.

FIG. 9 is a view when the container main body 12 is viewed from the Y axis positive direction side (a first side). FIG. 10 is a view when the container main body 12 is viewed from the Y axis negative direction side (a second side). FIG. 11 is an enlarged view of the first storage chamber 350 shown in FIG. 9. FIG. 11 also describes a view in which the narrow channel 370 is schematically three-dimensionally shown. In the container main body 12 shown in FIG. 10, the valve unit 70 is disposed in the valve chamber 79. The first side indicates the Y axis positive direction side with respect to one wall 12*p* of the plurality of walls which partition the outer shape of the liquid storage chamber 120. Moreover, the second side indicates the Y axis negative direction side with respect to the wall 12*p*.

As shown in FIGS. 9 and 10, the atmosphere opening port 19 directly communicates with the first atmosphere channel 210. The first atmosphere channel 210 is formed on the first side. The meandering channel 214 directly communicates with the first atmosphere channel 210 by a communication hole 212 which passes through the container main body 12. As shown in FIG. 10, the gas-liquid separation chamber 220 directly communicates with the downstream side end of the meandering channel 214. A communication hole 230 is formed on the bottom surface of the gas-liquid separation chamber 220. Moreover, a bank 222 is formed on the inner wall which surrounds the bottom surface of the gas-liquid separation chamber 220. The gas-liquid separation film 56 is adhered to the bank 222. In addition, the "directly communicating" means that other channels (chambers) do not exist between the channels (chambers) which communicate with each other. In other words, the "directly communicating" means that the channels (chambers) which communicate with each other are connected to each other and disposed so as to be adjacent. That is, the "directly communicating" means that the opening (hole) which can circulate the fluid with respect to one channel (chamber) and the opening (hole) which can circulate the fluid with respect to the other channel (chamber) are common between the channels (chambers) which communicates with each other.

As shown in FIG. 9, the second atmosphere channel 234 directly communicates with the gas-liquid separation chamber 220 through the communication hole 230. The second atmosphere channel 234 is formed on the first side of the cartridge 10. As shown in FIGS. 9 and 10, the third atmosphere channel 238 directly communicates with the second atmosphere channel 234 through the communication hole 236. The third atmosphere channel 238 is formed on the second side of the cartridge 10.

As shown in FIG. 9, the air chamber 245 directly communicates with the third atmosphere channel 238 through the communication hole 240. The air chamber 245 is formed on the first side of the cartridge 10. Specifically, the air chamber 245 is formed from the upper surface wall portion 13 to the bottom surface wall portion 14 in the mounting state. That is, in the air chamber 245, the upper surface wall portion 13 configures the upper surface 235*a* , and the bottom surface wall portion 14 configures the bottom surface 245*b* . Moreover, in the air chamber 245, a portion of the surface is formed by the front surface wall portion 15.

The air chamber 245 includes a first air chamber 244 which includes the upper surface 245*a* , and a second air chamber 248 which includes the bottom surface 245*b* . In the mounting state, the second air chamber 248 is positioned above the first air chamber 244. Moreover, a plate-like partition wall 402 is disposed in the inner portion of the air chamber 245. The partition wall 402 is disposed between the first air chamber 244 and the second air chamber 248. That is, in the mounting state, the partition wall 402 configures the bottom surface of the first air chamber 244. Moreover, in the mounting state, the partition wall 402 configures the upper surface of the second air chamber 248. The volume of the first air chamber 244 is smaller than that of the second air chamber 248.

In addition, the partition wall 402 partitions the first air chamber 244 and the second air chamber 248. The partition wall 402 includes a notch 246. The notch 246 is formed on the end surface of the partition wall 402. The notch 246 causes the first air chamber 244 and the second air chamber 248 to communicate with each other. Specifically, the film 55 (FIG. 5A) is stuck to the end surface of the partition wall 402, and thus, the notch 246 functions as a communication hole 246 which causes the first air chamber 244 and the second air chamber 248 to communicate with each other. The opening area of the notch (communication hole) 246 is smaller than the cross-sectional areas of the channels of the surrounding portions. That is, a predetermined channel which includes the notch (communication hole) 246 at the middle of the channel has the smallest channel cross-sectional area at the notch (communication hole) 246. For example, the opening area of the notch (communication hole) 246 is smaller than the opening area of the atmosphere opening port 19.

The second air chamber 248 directly communicates with the third atmosphere channel 254, which is positioned in the downstream side, through the communication hole 250. Moreover, a decompression chamber 84*a* which directly communicates with the decompression hole 84 is formed on the first side so as to be adjacent to the second air chamber 248. In the cartridge 10 when ink is injected to an unused cartridge 10, the decompression chamber 84*a* communicates with the second air chamber 248 by the communication hole 249. After the ink is injected to the unused cartridge 10 and the ink is stored in the liquid storage chamber 120, the communication hole 249 is blocked, and the decompression chamber 84*a* becomes a channel which is independent from other channels.

The second air chamber 248 includes the communication hole 250 as an air chamber communication hole. The communication hole 250 is formed so as to pass through in the Y axis direction in the container main body 12. The second air chamber 248 further includes two air-chamber plate members 304 and 306. The two air-chamber plate members 304 and 306 are horizontally disposed in the mounting state respectively. The two air-chamber plate members 304 and 306 are disposed with intervals in the mounting state. In the mounting state, two air-chamber plate members 304 and the 306 are disposed so as to interpose the communication hole 250 along with the bottom surface 245*b*.

As shown in FIG. 10, the third atmosphere channel 254 which is the second atmosphere introduction channel directly communicates with the air chamber 245 through the communication hole 250. The third atmosphere channel 254 extends in two directions perpendicular to each other. That is, the third atmosphere channel 254 includes a channel which extends in the horizontal direction in the mounting state and a channel which extends in a vertical direction in the mounting state. The third atmosphere channel 254 is a groove-like channel which is formed on the second side of the container main body 12. The third atmosphere channel 254 includes a narrow atmosphere channel 254*a* at the middle of the atmosphere channel, in which the channel cross-sectional area is formed so as to be smaller than the surrounding channel cross-sectional area due to a member 388 which forms the supply channel 388 which is a portion of the liquid guiding channel 130. Due to the member 388, the bottom surface of the groove-like narrow atmosphere channel 254*a* becomes higher than the surrounding portion.

As shown in FIG. 9, the second storage chamber 302 directly communicates with the third atmosphere channel 254 through the communication hole 256. The second storage chamber 302 is positioned above the first storage chamber 350 in the mounting state. Specifically, in one point of arbitrary points which are positioned on the horizontal surface in the mounting state, when the heights between the first storage chamber 350 and the second storage chamber 302 are compared to each other, the second storage chamber 302 is positioned above the first storage chamber.

As shown in FIG. 9, in the liquid communication channel 330, one end opening 311 which is the upstream side end directly communicates with the second storage chamber 302, and the other end opening 315 which is the downstream side end directly communicates with the first storage chamber 350. The one end opening 311 is formed by the notch of the end surface of the partition wall 408 which is one of the ribs 300. The opening area of the one end opening 311 is smaller than the channel cross-sectional areas of the surrounding portions. That is, a predetermined channel which includes the one end opening 311 at the middle of the channel has the smallest channel cross-sectional area at the one end opening 311. Here, it is preferable that the opening area of the one end opening 311 have a dimension of an extent in which the ink can circulate and the circulation of the bubbles can be prevented. For example, the opening area of the one end opening 311 is smaller than the opening area of the communication port 360 of the first storage chamber described below. Moreover, the volume of the liquid communication channel 330 is smaller than the volume of each of the second storage chamber 302 and the first storage chamber 350.

As shown in FIGS. 9 and 10, the liquid communication channel 330 includes a first liquid communication channel 309, a second liquid communication channel 310, a third liquid communication channel 314, and a fourth liquid communication channel 316 in the above order from the upstream side toward the downstream side. The first liquid communication channel 309 directly communicates with second storage chamber 302 by the one end opening 311 which is the upstream side end. The first liquid communication channel 309 extends in the horizontal direction (specifically, the X axis positive direction) in the mounting state. The second liquid communication channel 310 directly communicates with the first liquid communication channel 309 through the communication hole 308. The second liquid communication channel 310 extends in the vertical direction (specifically, vertically downward direction) in the mounting state. The third liquid communication channel 314 directly communicates with the second liquid communication channel through the communication hole 312. The third liquid communication channel 314 extends in the horizontal direction (specifically, the X axis negative direction) and the vertical direction (specifically, vertically downward direction) in the mounting state. The fourth liquid communication channel 316 directly communicates with the third liquid communication channel 314 through the communication hole 313. Moreover, the other end opening 315 of the fourth liquid communication channel 316 directly communicates with the second storage chamber 302. The fourth liquid communication channel 316 mainly extends in the vertical direction (specifically, vertically upward direction) in the mounting state. As described above, the liquid communication channel 330 is a channel which is curved so as to extend in at least two directions perpendicular to each other (the X axis direction and the Z axis direction).

As shown in FIG. 11, the first storage chamber 350 includes a plurality of partitioned storage chambers which are partitioned by a first partition wall 420 and a second partition wall 421. Each of the first partition wall 420 and the second partition wall 421 is a plate shape and configures one of the plurality of ribs 300. The plurality of partitioned storage chambers include a first partitioned storage chamber 342, a second partitioned storage chamber 346, and a first member storage chamber 344. Moreover, the first storage chamber 350 includes the communication port 360 of the first storage chamber and a communication port 362 of the second storage chamber. The communication port 360 of the first storage chamber is formed so as to include the opened end 420*p* of the first partition wall 420 as a portion. The communication port 362 of the second storage chamber is formed so as to include the opened end 421*p* of the second partition wall 421 as a portion. The end 421*p* is positioned at the side nearest to the bottom surface 14 in the second partition wall 421. The communication port 360 of the first storage chamber is formed by a gap between the end 420*p* and the outer wall surface which partitions and forms the first storage chamber 350. Moreover, the communication portion 362 of the second storage chamber formed by a gap between the end 421*p* and the outer wall surface which partitions and forms the first storage chamber 350. Here, gaps, in the case where the gaps between the ends 420*p* and 421*p* and the outer wall surface of the first storage chamber 350 become smallest gaps, are set to the communication ports 360 and 362 of the first and second storage chambers respectively.

The first member storage chamber 344 includes a first member disposition surface (bottom surface) 350*b* which configures the inner wall surface of the first storage chamber 350. The first member disposition surface 350*b* is a plane which is positioned at the lowest position of the surfaces of the first storage chamber 350 (liquid storage chamber 120) in the mounting state. Moreover, the first member disposition surface 350*b* is rectangular. The prism 61 is disposed on the first member disposition surface 350*b* . A portion of the first member disposition surface 350*b* is formed by the first member unit 60. Here, the first member disposition surface 350*b* is not necessary to be completely planar, and a portion of the surface may have unevenness. That is, the first member disposition surface 350*b* may be an approximately plane. The first member disposition surface 350*b* becomes a horizontal surface in the mounting state. Accordingly, the mounting state may also be referred to the state (first state) where the first member disposition surface 350*b* is horizontal. Moreover, in the mounting state, the top side (the side which is positioned farthest from the first member disposition surface 350*b* ) in the prism 61 becomes the highest position. Accordingly, the mounting state may also be referred to a state where the top side (the ridgeline 61*t* which forms the vertical angle) in the prism 61 become the highest position.

The prism 61 is disposed at the position closer to the rear surface 16 than the front surface 15 in the opposite direction (X axis direction) in which the rear surface 16 and the front surface 15 are opposite to each other.

The first partitioned storage chamber 342 directly communicates with the liquid communication channel 330. Moreover, the first partitioned storage chamber 342 directly communicates with the first member storage chamber 344 by the communication port 360 of the first storage chamber. Moreover, in the mounting state, the first partitioned storage chamber 342 is positioned above the first member storage chamber 344. The second partitioned storage chamber 346 does not directly communicate with the first partitioned storage chamber 342. The second partitioned storage chamber 346 directly communicates with the first member storage chamber by the communication port 362 of the second storage chamber. Specifically, the second partitioned storage chamber 346 communicates with other regions by only the communication port 362 of the second storage chamber. Here, the second partitioned storage chamber 346 is also referred to an upper storage chamber 346.

In the mounting state, the first partition wall 420 and the second partition wall 421 configure the upper surface of the first member storage member 344. In the mounting state, the first partition wall 420 is inclined with respect to the horizontal plane so as to be gradually higher as the wall approaches the communication port 360 of the first storage chamber from the one end 420*a* and is toward the other end 420*p* . In mounting state, the second partition wall 421 is inclined with respect to the horizontal plane so as to be gradually higher as the wall approaches the communication port 360 of the first storage chamber from the one end 421*p* and is toward the other end 421*a* . Moreover, the base surface of the height is a predetermined horizontal plane.

In the first partition wall 420, a notch 420*r* is formed on the end surface to which the film 55 is stuck. Two notches 420*r* are formed. In addition to the communication port 360 of the first storage chamber, also by the notches 420*r* , the first partitioned storage chamber 342 and the first member storage chamber 344 communicate with each other. That is, the notches 420*r* may also be referred to communication holes 420*r* which cause the first partitioned storage chamber 342 and the first member storage chamber 344 to communicate with each other. It is preferable that the opening area of the notch 420*r* have a dimension of an extent in which the ink can circulate and the circulation of the bubbles, which exist in the first member storage chamber 344, can be prevented. For example, the opening area of each of the two notches 420*r* is smaller than the opening area of the communication port 360 of the first storage chamber.

The first partition wall 420 includes a first separation wall 420*b* which includes the one end 420*a* of the first partition wall 420, and a second separation wall 420*c* which is connected to the first separation wall 420*b* and includes the other end 420*p* of the first partition wall 420. The degree of inclination (inclination angle) of the second separation wall 420*c* with respect to the horizontal plane is larger than that of the first separation wall 420*b*.

The first member storage chamber 344 includes a first inner wall 424 which is positioned between the upper surface (specifically, the first partition wall 420) of the first member storage chamber 344 and the first member disposition surface 350*b* in the mounting state. The first inner wall 424 is one of the plurality of ribs 300. The first inner wall 424 is a plate shape. The first inner wall 424 is disposed so as to cover the prism 61. The first inner wall 424 is disposed immediately above the prism 61 in the mounting state.

An one end 424*a* of the first inner wall 424 is connected to a portion 300*t* of the outer wall which partitions and forms the first storage chamber 350. Moreover, the other end 424*b* of the first inner wall is opened so as not be connected to other members. In the mounting state, the first inner wall 424 is inclined with respect to the horizontal plane so as to be gradually higher from the one end 424*a* toward the other end 424*b* . In other words, the first inner wall 424 is inclined so that the distance from the first member disposition surface 350*b* is gradually increased from the one end 424*a* positioned on the rear surface 16 side toward the other end 424*b* positioned on the front surface 15 side.

The first inner wall 424 includes a notch 424*r* on the end surface to which the film 55 is stuck. In the mounting state, the notch 424*r* is formed on the one end 424*a* which becomes the lowest position in the first inner wall 424. In order words, the notch 424*t* is positioned at a position in which the distance from the first member disposition surface 350*b* is the shortest distance in the first inner wall 424. Thereby, in the mounting state, the ink on the first inner wall 424 can be circulated to the first member disposition surface 350*b* side (lower side) due to the notch 424*r* , and the possibility that the ink may remain on the first inner wall 424 can be decreased. Moreover, the position of the notch 424*r* is not limited to the above-described, and the notch may be provided at a position which comes into contact with the one end 424*a* of the first inner wall 424 or at a position which is close to the one end 424*a* . Here, the notch 424*r* may also be referred to a communication hole 424*r* which causes the upper side and the lower side of the first inner wall 424 to communicate with each other in the mounting state.

It may be considered that the first member storage chamber 344 is divided into a plurality of regions as follows. That is, the first member storage chamber 344 includes a first bottom chamber 344*t* and a second bottom chamber 344*w* which is a portion other than the first bottom chamber 344*t* . The first bottom chamber 344*t* is a region which is interposed between the first inner wall 424 and the first member disposition surface 350*b* . That is, in the mounting state, in the first bottom chamber 344*t* , the first member disposition surface 350*b* becomes the bottom surface and the first inner wall 424 becomes the upper surface. For easy understanding, in FIG. 11, a dotted line is attached the boundary between the first bottom chamber 344*t* and the second bottom chamber 344*w*.

Moreover, the second bottom chamber 344*w* may be divided into a first division chamber 344*w* 1 and a second division chamber 344*w* 2. For easy understanding, in FIG. 11, a dashed line is attached to the boundary between the first division chamber 344*w* 1 and the second division chamber 344*w* 2. The first division chamber 344*w* 1 is a region which is interposed between the first inner wall 424 and the first partition wall 420. That is, in the mounting state, in the first division chamber 344*w* 1, the first inner wall 424 becomes the bottom surface and a portion of the first partition wall 420 becomes the upper surface. The second division chamber 344*w* 2 includes the other portion of the first partition wall 420 and the second partition wall 421 as a portion of the upper surface in the mounting state. The second division chamber 344*w* 2 directly communicates with the second partitioned storage chamber 346 through the communication port 362 of the second storage chamber.

In the mounting state, the second partitioned storage chamber 346 is positioned above the first member storage chamber 344. In the mounting state, the second partitioned storage chamber 346 is provided at a different position which does not overlap with the prism 61 when the cartridge 10 is vertically projected on the horizontal plane.

The communication port 362 of the second storage chamber is formed so that the prism 61 is not positioned in an opening direction 362V. The opening direction 362V is a direction perpendicular to the opening surface. In the present embodiment, the opening direction 362V is the vertical direction in the mounting state. Moreover, the communication port 362 of the second storage chamber is formed in the lower end which is the lowest portion of the second partitioned storage chamber 346 in the mounting state.

A predetermined channel in the vicinity of the communication port 360 of the first storage chamber which includes the communication port 360 of the first storage chamber has the following relationships in the flow direction of the ink (also referred to a "flow direction in storage chamber") which circulates from the first partitioned storage chamber 342 to the first member storage chamber 344 through the communication port 360 of the first storage chamber. That is, the channel cross-sectional area is gradually decreased toward the communication port 360 of the first storage chamber in the upstream side portion of the communication port 360 of the first storage chamber. Moreover, the channel cross-sectional area is gradually increased as the channel is away from the communication port 360 of the first storage chamber in the downstream side portion of the communication port 360 of the first storage chamber. In order words, in the flow direction in the storage chamber, the channel, which includes the communication port 360 of the first storage chamber at the middle of the channel in the first storage chamber 350, has the smallest channel cross-section area at the communication port 360 of the first storage chamber.

Figure 12:
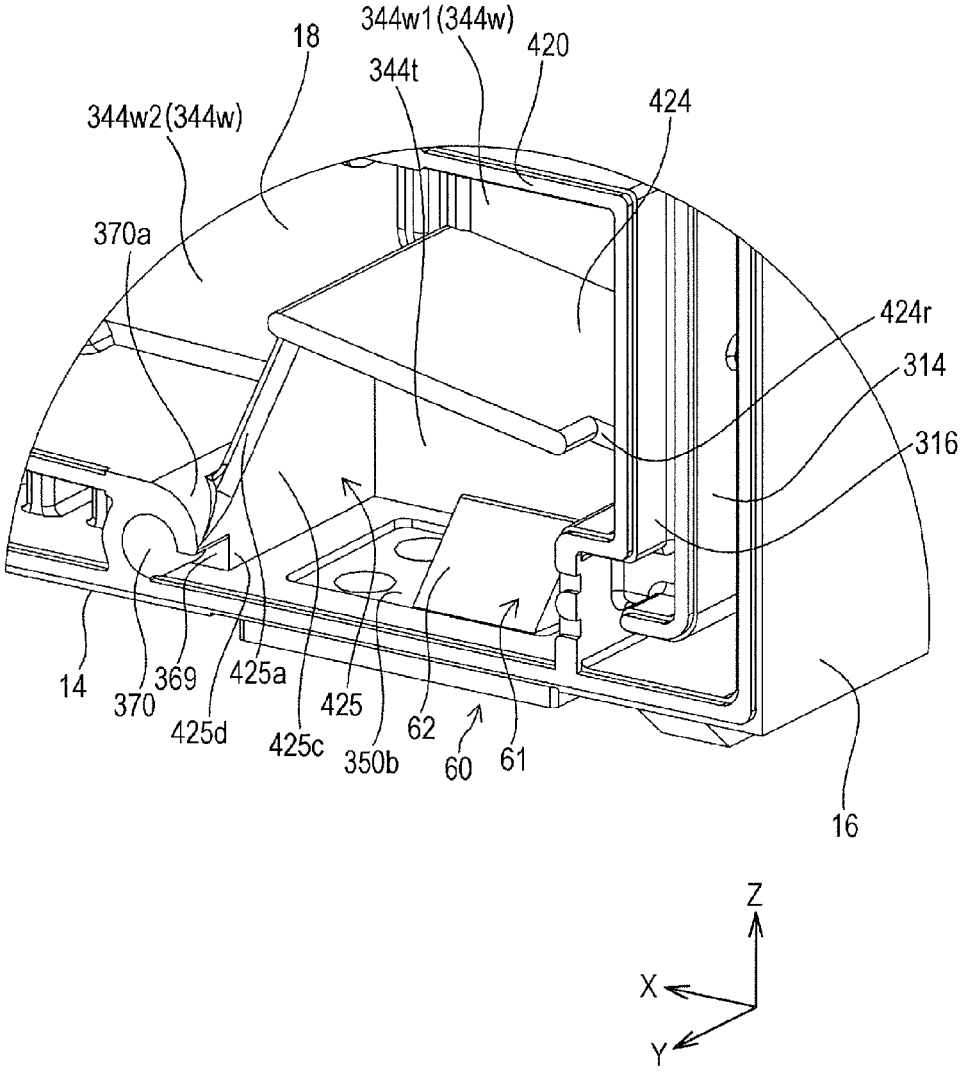
FIG. 12 is a perspective view in the vicinity of a first bottom chamber 344*l* of the container main body 12.

FIG. 12 is a perspective view in the vicinity of the first bottom chamber 344*t* of the container main body 12. The detail configurations in the vicinity of the first bottom chamber 344*t* will be described with reference to FIGS. 11 and 12.

As shown in FIGS. 11 and 12, the first storage chamber 350 includes a bottom surface partition wall 425 which is disposed in the inner portion. The bottom surface partition wall 425 extends from the first member disposition surface 350*b* . Specifically, the bottom surface partition wall 425 extends from one side of the front surface 15 side (the X axis positive direction side) of the first member disposition surface 350*b* . The bottom surface partition wall 425 is provided at a position which does not overlap with the first inner wall 424 when the cartridge 10 is vertically projected on the horizontal plane in the mounting state. That is, the bottom surface partition wall 425 is provided at a position which is different from the first inner wall 424 in the X axis direction. A first main surface 425*c* of the first inner wall 424 which faces the prism 61 extends in the vertical direction in the mounting state.

In the mounting state, a liquid communication hole 369 is formed at a position below the first inner wall 424. Specifically, the liquid communication hole 369 is formed on a lower end 425*d* of the bottom surface partition wall 425 which comes into contact with the first member disposition surface 350*b* . That is, the liquid communication hole 369 is provided so as to come into contact with the first member disposition surface 350*b* . In other words, a portion of the inner surface of the liquid communication hole 369 may be formed by a portion of the first member disposition surface 350*b* . The liquid communication hole 369 is formed so as to pass through the bottom surface partition wall 425 along the thickness direction of the bottom surface partition wall 425. In addition, the mounting state, the liquid communication hole 369 is provided at the position which does not overlap with the first inner wall 424 when the cartridge 10 is vertically projected on the horizontal plane. The liquid communication hole 369 is formed by a notch which is formed on the lower end 425*d* of the bottom surface partition wall 425. The liquid communication hole 369 directly communicates with the first storage chamber 350 and the narrow channel 370. Here, the liquid communication hole 369 may also be referred to a downstream side end of the liquid storage chamber 120. Moreover, the liquid communication hole 369 may also be referred to an upstream side end of the liquid guiding channel 130. The liquid communication hole 369 extends along the X axis direction.

As shown in FIG. 11, the channel cross-sectional area of the narrow channel 370 is smaller than the channel cross-sectional area of a portion (a first portion) 61*s* of the liquid storage chamber 120 in which the prism 61 is disposed. For example, the first portion 61*s* is the cross-section 61*s* which passes through the prism 61 in the cross-section parallel to the Y axis direction and the Z axis direction of the liquid storage chamber 120. The first portion 61*s* is a plane which extends from the first member disposition surface 350*b* to the first inner wall 424. That is, the channel cross-sectional area of the portion in which the prism 61 is disposed may also be referred to the channel cross-sectional area of the portion of the first bottom chamber 344*t* in which the prism 61 is disposed. The "cross-section parallel to the Y axis direction and the Z axis direction" may also be referred to the cross-section perpendicular to the ridgeline 61*t* which forms the vertical angle of the prism 61. In addition, the "cross-section parallel to the Y axis direction and the Z axis direction" is a cross-section perpendicular to the first member disposition surface 350*b* , and may also be referred to a cross-section parallel to the width direction (Y axis direction) of the cartridge 10. Here, the cross-section 61*s* may be a cross-section of an arbitrary position if the cross-section 61*s* is positioned within a range in which the prism 61 is positioned. Moreover, in the channels which through the liquid flows toward the narrow channel 370 in the first storage chamber 350, the channel cross-sectional area of the narrow channel 370 is smaller than the channel cross-sectional areas of the channels of the first partitioned storage chamber 342, the communication port 360 of the first storage chamber, the second division chamber 344*w* 2, and the first bottom chamber 344*t* disposed in the above order. Moreover, the opening area of the liquid communication hole 369 is smaller than the channel cross-sectional area of the narrow channel 370 described below. The channel cross-sectional area of the narrow channel 370 is the area of a cross-section 370*s* of the narrow channel 370 perpendicular to the direction (Y axis direction) in which the narrow channel 370 extends. The predetermined position may be an arbitrary position of the narrow channel 370. The cross-section 370*s* is a cross-section perpendicular to the X axis direction and the Z axis direction. Moreover, an average (a value which divides the volume of the narrow channel 370 by the channel length) of the channel cross-sectional areas of the narrow channel 370 may be smaller than an average (a value which divides the volume of a first side channel by the channel length) of the channel cross-sectional areas of the first side channel (for example, the first storage chamber 350, the second storage chamber 302, and the air chamber 245) which is a channel formed in the side (first side) on which the liquid storage chamber 120 is formed.

At least a portion of an upper end 425*a* which is positioned at the Y axis positive direction side of the bottom surface partition wall 425 is inclined so that the distances from the first member disposition surface 350*b* are different from each other. Specifically, in the upper end 425*a* , the distance from the first member disposition surface 350*b* is gradually increased from the Y axis positive direction side in which the liquid communication hole 369 is positioned toward the Y axis negative direction side.

As shown in FIG. 12, the first storage chamber 350 includes a communication surface 370*a* . The communication surface 370*a* is positioned above the liquid communication hole 369 in the mounting state. The communication surface 370*a* is disposed to be close to the liquid communication hole 369. In other words, the communication surface 370*a* is connected to the bottom surface partition wall 425. In the X axis direction, the communication surface 370*a* is disposed in the side opposite to the rear surface 16 while interposing the prism 61. The communication surface 370*a* is a curved surface. The communication surface 370*a* may be a portion of the outer surface of the member which forms the narrow channel 370. The communication surface 370*a* is inclined so as to be gradually close to the front surface 15 in the X axis direction from the lower side toward the upper side in the mounting state. That is, the communication surface 370*a* is positioned in a direction which is gradually away from the prism 61 from the lower side toward the upper side.

As shown in FIGS. 11 and 12, the first through channel 370 linearly extends along the Y axis direction. The first through channel 370 extends from the first side of the container main body 12 to the second side. The first through channel 370 directly communicates with the first storage chamber 350 through the liquid communication hole 369.

Next, the channels of the downstream side of the first through channel 370 will be described with reference to FIGS. 9 and 10. As shown in FIG. 10, the first liquid channel 372 directly communicates with the first through channel 370. The extension direction (channel direction) of the first liquid channel 372 is different from that of the first through channel 370. That is, in the first liquid channel 372, the channel is formed along the plane parallel to the X axis direction and the Z axis direction. The first liquid channel 372 includes a channel 372*a* which extends in the Z axis positive direction from the upstream side toward the downstream side. In other words, the channel 372*a* extends in the vertically upward direction in the mounting state from the upstream side toward the downstream side. The first liquid channel 372 is formed on the second side of the cartridge 10. Moreover, the channel cross-sectional area of the first liquid channel 372 is smaller than the channel cross-sectional area of the portion (first portion) 61*s* (FIG. 11) in which the prism 61 is disposed in the liquid storage chamber 120. Moreover, in the channels through which the liquid flows toward the narrow channel 370 in the first storage chamber 350, the channel cross-sectional area of the first liquid channel 372 is smaller than the channel cross-sectional areas of the channels (FIG. 11) of the first partitioned storage chamber 342, the communication port 360 of the first storage chamber, the second division chamber 344*w* 2, and the first bottom chamber 344*t* disposed in the above order.

As shown in FIG. 9, the second liquid channel 378 directly communicates with the first liquid channel 372 through the communication hole 376. In the second liquid channel 378, the channel is formed along a plane parallel to the X axis direction and the Z axis direction. The second liquid channel 378 includes a channel 378*a* which extends in the Z axis negative direction from the upstream side toward the downstream side. In other words, the channel 372*a* extends in the vertically downward direction in the mounting state from the upstream side toward the downstream side. That is, the channel 372*a* (FIG. 10) and the channel 378*a* extend in the directions (reverse directions) opposite to each other. The second liquid channel 378 is formed on the first side of the cartridge 10.

As shown in FIGS. 9 and 10, the valve chamber 79 directly communicates with the second liquid channel 378 through the communication hole 380. The first vertical channel 382 directly communicates with the valve chamber 79 through the valve hole 381. The first vertical channel 382 extends in the vertical direction in the mounting state. The supply channel 388 directly communicates with the first vertical channel 382 through the communication hole 384. The supply channel 388 is a channel which is formed by only the container main body 12. The channel cross-section of the supply channel 388 is approximately circular. The portion of the supply channel 388 which protrudes from the bottom surface 14 configures the liquid supply portion 40.

Figure 13:
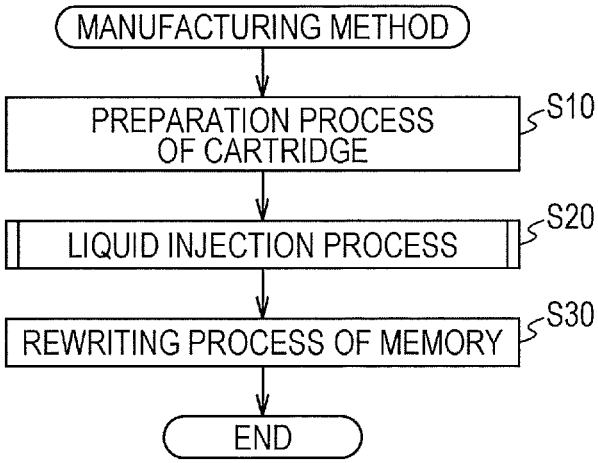
FIG. 13 is a flowchart for illustrating a method of manufacturing a cartridge.

A-5. Method of Manufacturing Cartridge:

FIG. 13 is a flowchart for illustrating a method of manufacturing the cartridge. In the present embodiment, a method of manufacturing the cartridge 10 (a method of manufacturing the cartridge according to a so-called refill process) will be described, in which the cartridge 10, in which the ink is stored, is manufactured by injecting ink again with respect to the cartridge 10 which is mounted on the printer 1 and used and in which the ink residual quantity is less than or equal to a predetermined value. Moreover, the method of manufacturing the cartridge 10 described below also may use a method of manufacturing the cartridge 10, in which the ink is stored, by injecting ink with respect to an unused cartridge 10.

As shown in FIG. 13, the method of manufacturing the cartridge 10 includes a preparation process (step S10) of preparing the above-described cartridge 10, a liquid injection process (step S20) of storing the ink in the liquid storage chamber 120 by injecting the ink, and a rewriting process (step s30) of a memory. In the present embodiment, the injection point of the ink injection which is performed by the liquid injection process (step S20) is the liquid storage chamber 120 or the channel of the upstream side of the liquid storage chamber 120 based on the flow direction of the fluid from the atmosphere opening port 19 to the supply port 42.

The rewriting process (step S30) is a process which rewrites the information of ink consumption of the memory provided on the circuit substrate 30 of the cartridge 10 to an usable value (step S30). When the ink is used and the ink residual quantity of the cartridge 10 is less than or equal to a predetermined value, the information which represents the ink residual quantity being less than or equal to the predetermined value may be stored in the memory. In this case, the printer 1 determines that the ink does not exist in the cartridge 10, and may not be shifted to the printing operation normally. In order to avoid the disadvantages, the information of the ink consumption of the memory is rewritten to an usable value which indicates that the ink exists equal to or more than the predetermined value. Moreover, the step S30 can be omitted.

Figure 14:
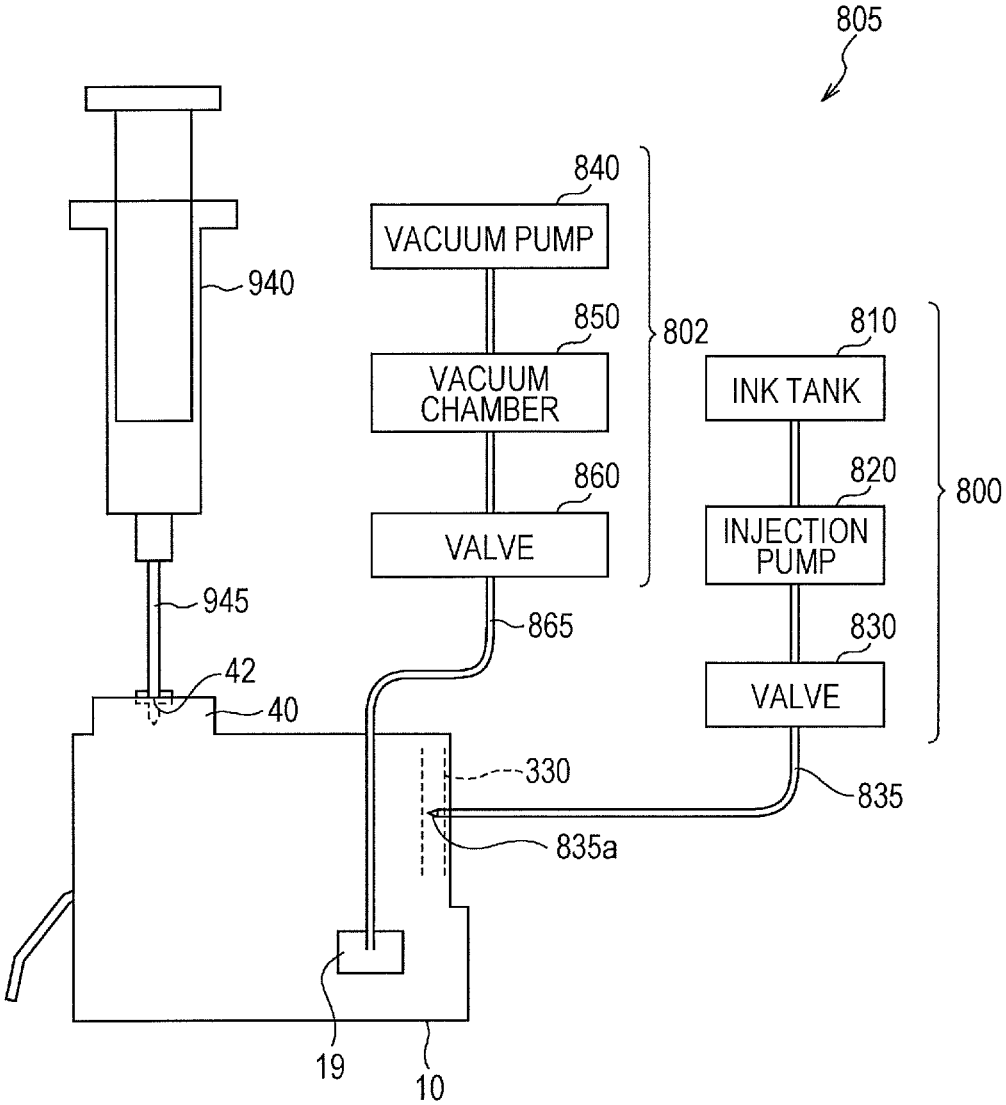
FIG. 14 is a view for illustrating an example of a specific method of an ink injection.

FIG. 14 is a view for illustrating an example of a specific method of an ink injection. For example, the ink injection is performed using an injection instrument 805. The injection instrument 805 includes a liquid injection unit 800, a vacuum unit 802, and a sucker 940. The liquid injection unit 800 includes a liquid injection tube 835, a valve 830, an injection pump 820, and a tank 810. The valve 830 is disposed at the upstream side of the liquid injection tube 835. The injection pump 820 is disposed at the upstream side of the valve 830. The tank 810 is disposed at the upstream side of the injection pump 820. For example, the liquid injection tube 835 may use a needle-like tube. The tip 835*a* of the liquid injection tube 835 is opened, and the ink may be flowed out from the tip 835*a* to the outside. FIG. 14 schematically shows an aspect in which the ink is injected from the liquid communication channel 330. The vacuum unit 802 includes a suction tube 865, a valve 860, a vacuum chamber 850, and a vacuum pump 840. The valve 860 is disposed at the upstream side of the suction tube 865. The vacuum chamber 850 is disposed at the upstream side of the valve 860. The vacuum pump 840 is disposed at the upstream side of the vacuum chamber 850. For example, the suction tube 865 may use a needle-like tube. The syringe-like sucker 940 includes a suction tube 945. The suction tube 945 is a needle shape, inserted into the supply port 42, and pushes up the spring seat 44.

Figure 15:
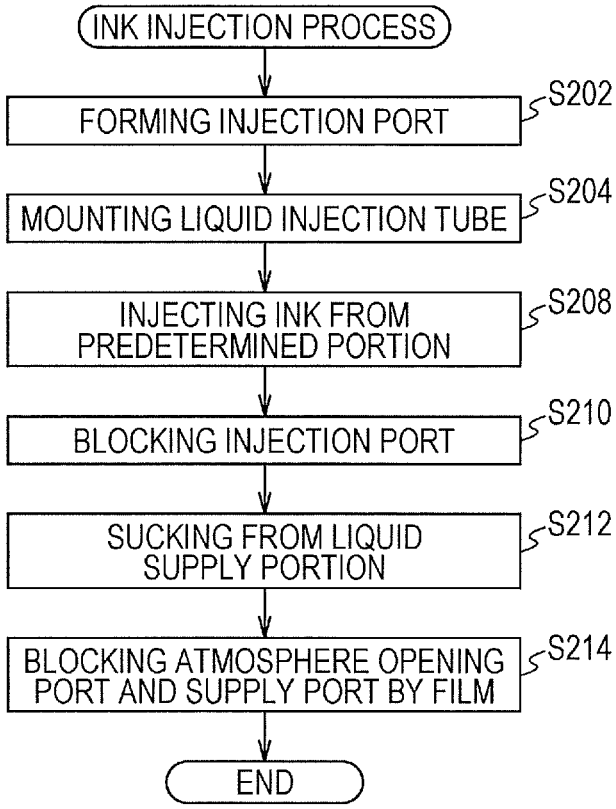
FIG. 15 is a specific flow of a liquid injection process.

FIG. 15 is a specific flow of the liquid injection process. First, in the liquid injection process (step S20), an injection port is formed on the cartridge 10 in order to inject the ink to the inner portion of the cartridge 10 (step S202). The injection port is formed by making a hole on the liquid storage chamber 120 and a formation wall which forms a channel of the upstream side of the liquid storage chamber 120, in the channel 140 of the cartridge 10. The injection port may be provided on a formation wall which forms a predetermined portion which directly injects ink. For example, when ink is injected from the first air chamber 244 (FIG. 9) and the ink is stored (filled) in the liquid storage chamber 120, the injection port is formed by making a hole on the formation wall which forms the first air chamber 244. Here, one of the formation walls which form the first air chamber 244 is the film 55 (FIG. 5A). Moreover, the other one of the formation walls which form the first air chamber 244 is the front surface wall portion 15 (FIG. 9). For example, the injection port may be formed by making a hole on the formation wall using a drill. In addition, for example, the injection port may be formed by piercing the formation wall with the liquid injection tube 835 and making a hole. For example, when the injection port is formed on the film 55, the cover member 11 (FIG. 3) is removed and the hole may be formed only on the film 55, and the hole is formed on the cover member 11 and the film 55 in a state where the film 55 is covered on the cover member 11.

As described above, the injection port is formed by making the hole on the formation wall which forms the channel 140. Moreover, the injection port is formed, and thus, ink can be easily injected to the inner portion of the cartridge 10 through the injection port. In addition, the injection port can be easily formed by making a hole on the films 54 and 55 in the formation wall.

If the injection port is formed, the liquid injection tube 835 is mounted on the injection port (step S204). In the step S204, ink is injected to the inner portion of the cartridge 10 from the liquid storage chamber 120 of the channel 140 (FIG. 6) of the cartridge 10 and the upstream side of the liquid storage chamber 120 (ink injection). Moreover, when the liquid injection tube 835 directly pierces the formation wall, the step S202 and S204 are simultaneously performed.

After the step S204, suction inside the cartridge 10 starts through the atmosphere opening port 19 by the vacuum unit 802 which is mounted on the atmosphere opening port 19 (step S204). Specifically, after the vacuum pump 840 is operated in a state where the valve 860 is opened and the inner portion of the vacuum chamber 850 is sufficiently decompressed, the valve 860 is opened, and thus, the inner portion of the cartridge 10 is sucked from the atmosphere opening port 19. According to the step S204, the inner portion of the channel 140 of the cartridge 10 is decompressed. In addition, a mounting time of the vacuum unit 802 to the atmosphere opening port 19 may be performed at an arbitrary timing if the mounting time is before the step S206 starts.

After the step S204, the ink is injected from the predetermined portion, and the ink is stored in the liquid storage chamber 120 (step S208). Specifically, in the state where the suction from the atmosphere opening port 19 is maintained, the injection pump 820 is operated and the valve 830 is opened. Thereby, the ink in the tank 810 is injected from the predetermined portion of the cartridge 10.

In the step S208, if a predetermined amount of ink is stored in the liquid storage chamber 120, the operation of the liquid injection unit 800 stops and the ink injection stops. In addition, the operation of the vacuum unit 802 also stops. Moreover, the liquid injection unit 800 and the vacuum unit 802 are removed from the cartridge 10.

After the step S208, the injection port is sealed (step S210). For example, in the sealing of the injection port, the injection port is sealed by a member having elasticity such as a film or rubber. Thereby, the possibility that the ink stored in the inner portion of the cartridge 10 may be flowed out to the outside through the injection port can be decreased.

When the inner portion of the cartridge 10 is sucked from the atmosphere opening port 19, since the valve member 73 is closed, the ink is not injected to the downstream side of the valve member 73. Accordingly, after the step S210, the sucker 940 in which the tip of the suction tube 945 is inserted into the liquid supply portion 40 is operated so as to be sucked (step S212). Thereby, the valve member 73 is opened, and the ink is introduced from the upstream side of the valve member 73 to the downstream side (step S212).

After the step S212, the atmosphere opening port 19 and the supply port 42 are blocked by the films 52 and 51 respectively (step S214). Thereby, the liquid injection process ends.

As described above, in the method of manufacturing the cartridge 10, in order to store the ink in the liquid storage chamber 120, the ink is injected from the liquid storage chamber 120 or the upstream side of the liquid storage chamber 120, in the channel 140 from the atmosphere opening port 19 to the supply port 42. Thereby, at the time of the liquid injection process (step S20), ink can be stored in the liquid storage chamber 120 without passing through the narrow channel 370. Accordingly, at the time of the liquid injection process (step S20), the possibility that bubbles may stay in the narrow channel 370 and thus, the injection of the ink to the liquid storage chamber 120 may be impeded can be decreased. That is, the ink can be effectively stored in the liquid storage chamber 120.

Moreover, the downstream side of the liquid storage chamber 120 of the cartridge 10 includes the first liquid channel 372, in which the channel cross-sectional area is small and the channel length is long, in addition to the narrow channel 370. That is, if ink is injected at the downstream side of the liquid storage chamber 120, when the bubbles occur at the time of the ink injection, the possibility that bubbles which occur in the middle of the channel from the injection point to the liquid storage chamber 120 may stay is increased. Thereby, the possibility that the flow-in of the ink to the liquid storage chamber 120 may be impeded due to the staying bubbles is increased. However, in the above-described embodiment, since the liquid injection process (step S20) is performed from the liquid storage chamber 120 or the upstream side of the liquid storage chamber 120, the ink can be stored in the liquid storage chamber 120 without passing through the narrow channel 370 or the first liquid channel 372 in which bubbles easily stay.

Moreover, the first member storage chamber 344 includes the first inner wall 424 which is disposed so as to cover the prism 61 in the mounting state (FIG. 9). Thereby, when the cartridge 10 in which the ink is stored is mounted on the printer 1 and used, occurrence of the disadvantages may be decreased. For example, it is considered when bubbles are attached to the first partition wall 420 (specifically, the surface of the first partition wall 420 opposite to the prism 61). When the prism 61 is exposed from the ink liquid surface in the state where bubbles are attached to the first partition wall 420, in a normal state, the control unit 6 detects that "there is no ink residual quantity" using the optical detection device 5. However, if bubbles are attached to the first partition wall 420, the bubbles are broken, and there is the possibility that ink droplets may be attached to the prism 61. Even when only the ink quantity of the extent in which the control unit 6 detects that "there is no ink residual quantity" remains in the liquid storage chamber 120, if the ink droplets are attached to the prism 61, it may be erroneously detected that "there is an ink residual quantity". However, in the present embodiment, since the first inner wall 424 is provided, the possibility that the ink droplets may be attached to the prism 61 in the mounting state can be decreased, and occurrence of erroneous detection of the ink residual can be suppressed.

In addition, the first inner wall 424 is inclined with respect to the horizontal plane so as to be gradually higher in the mounting state from one end 424*a* of the rear surface 16 side toward the other end 424*b* of the front surface 15 side (FIG. 11). Thereby, even when bubbles occur around the prism 61 at the time of the ink injection described below, at the time of using of the cartridge 10, or the like, the bubbles can move in the direction, which is away from the prism 61, along the first inner wall 424. Thereby, the possibility that bubbles may reach the prism 61 and be attached thereto can be decreased. Accordingly, when the prism 61 is positioned in ink and it is detected that "there is an ink residual quantity" in a normal state, the possibility that bubbles may be attached to the prism 61 and erroneous detection may occur can be decreased. That is, detection accuracy of the ink residual quantity state using the prism 61 can be improved.

Moreover, in the above-described cartridge 10, the liquid communication hole 369 for circulating the ink to the downstream side of the liquid storage chamber 120 is provided so as to come into contact with the first member disposition surface 350*b* on which the prism 61 is disposed (FIG. 11). Thereby, an actual ink liquid surface when the printer 1 detects that "there is no ink residual quantity" using the prism 61 can be positioned so as to be close to the surface of the first member disposition surface 350*b*. Particularly, in the present embodiment, the first member disposition surface 350*b* is a plane which is positioned at the lowest position in the surface of the first storage chamber 350 (liquid storage chamber 120). Accordingly, when the printer 1 determines that "there is no residual quantity", the ink residual quantity in the liquid storage chamber 120 becomes small. That is, a situation, in which the cartridge 10 is exchanged in a state where the ink sufficiently exists in the liquid storage chamber 120, can be avoided.

Here, it is preferable that the liquid communication hole 369 have a shape (opening area) of an extent of sucking the ink, which comes into contact with the liquid communication hole 369 and is positioned on the first member disposition surface 350*b* , by capillarity. Thereby, when the cartridge 10 is mounted on the printer 1 and used, the ink which remains on the first member disposition surface 350*b* can be consumed.

A-6. Injection Point in Liquid Injection Process:

In the liquid injection process (step S20), the portion (injection point) which directly injects ink may be an arbitrary point if the portion is positioned at the liquid storage chamber 120 or the upstream side of the liquid storage chamber 120 in the channel 140. Hereinafter, the injection point will be described.

In the present embodiment, the gas-liquid separation film 56 is disposed in the atmosphere introduction channel 110 (FIG. 6). Accordingly, when the gas-liquid separation film 56 is disposed, it is preferable that the injection point be positioned at the downstream side of the gas-liquid separation film 56. Thereby, the possibility that the flow of the ink toward the liquid storage chamber 120 may be impeded due to the gas-liquid separation film 56 can be decreased. Accordingly, ink can be effectively stored in the liquid storage chamber 120 according to the liquid injection process (step S20).

In addition, the injection point may be positioned in the first storage chamber 350. If the injection point is positioned at the first storage chamber 350, ink can be directly injected to the liquid storage chamber 120, and the ink can be effectively stored in the liquid storage chamber 120.

Moreover, the injection point may be disposed at a portion in which the inner portion of the first storage chamber 350 can be viewed from the outside through the prism 61 in the first storage chamber 350. Thereby, at the time of the liquid injection process (step S30), the aspect in which the ink is injected to the liquid storage chamber 120 (particularly, first storage chamber 350) can be confirmed through the prism 61 from the outside.

Moreover, the injection point may be positioned in the first member storage chamber 344 in the first storage chamber 350 (FIG. 11). Thereby, the ink can be injected to the inner portion of the cartridge 10 from the first member storage chamber 344 in which the prism 61 is disposed. Moreover, the first partition wall 420 and the second partition wall 421 which configure the upper surface of the first member storage chamber 344 are inclined respectively so as to be gradually higher in the mounting state as the walls approach the communication port 360 of the first storage chamber from the one ends 420*a* and 421*p* and are toward the other ends 420*p* and 421*a* . Thereby, even when bubbles occur in the first member storage chamber 344 at the time of performing the liquid injection process (step S20), at the time of transporting the cartridge 10, or at the time of using the cartridge 10, the bubbles can be led to the first partitioned storage chamber 342 (the communication port 360 of the first storage chamber) by making the state of the cartridge 10 in the mounting state. Thereby, the possibility that bubbles may reach to the prism 61 and be attached thereto can be decreased.

Moreover, the injection point may be positioned in the first bottom chamber 344*t* (FIG. 11). Thereby, ink can be injected from the first bottom chamber 344*t* . Moreover, the first bottom chamber 344*t* is positioned at the lowest position in the liquid storage chamber 120 in the mounting state. Accordingly, for example, the ink injection is performed in a state where the posture of the cartridge 10 is the posture of the mounting state, and thus, the ink can be stored smoothly from the lower side of the liquid storage chamber 120 to the upper side. That is, the possibility that bubbles may occur in the injected ink of the liquid storage chamber 120 can be decreased.

Moreover, the injection point may be positioned in the second bottom chamber 344*w* (FIG. 11). The second bottom chamber 344*w* is a chamber which is different from the first bottom chamber 344*t* in which the prism 61 is disposed. Accordingly, ink is injected from the second bottom chamber 344*w* , and thus, even when bubbles occur at the time of the ink injection, the possibility that bubbles may reach the prism can be decreased.

Moreover, the injection point may be disposed in the first division chamber 344*w* 1 (FIG. 11). With respect to the vertical direction in the mounting state, the first inner wall 424 is positioned between the first division chamber 344*w* 1 and the prism 61. Accordingly, ink injected from the first division chamber 344*w* 1, and thus, even when bubbles occur at the time of the ink injection, the possibility that the generated bubbles may reach the prism 61 can be decreased. Moreover, the first partition wall 420 which forms the upper surface in the mounting state of the first division chamber 344*w* 1 is inclined so as to be gradually higher from the one end 420*a* toward the other end 420*p* (FIG. 11). Thereby, even when bubbles occur in the first division chamber 344*w* 1 at the time of the ink injection, at the time of transporting the cartridge, or the like, the bubbles can be led to the communication port 360 of the first storage chamber along the first partition wall 420 by making the cartridge 10 in the mounting state. That is, bubbles can be lead to the position (the communication port 360 of the first storage chamber) away from the prism 61, and thus, the possibility that the bubbles may reach the prism 61 and be attached thereto can be decreased.

Moreover, the injection point may be positioned in the second division chamber 344*w* 2 (FIG. 11). Thereby, ink can be directly injected from the second division chamber 344*w* 2 to the liquid storage chamber 120. Moreover, the first partition wall 420 and the second partition wall 421 which configure the upper surface of the second division chamber 344*w* 2 are inclined respectively so as to be gradually higher as the walls approach the communication port 360 of the first storage chamber in the mounting state. Thereby, even when bubbles occur in the second member storage chamber 344*w* 2 at the time of the liquid injection, at the time of transporting the cartridge 10, or the like, the bubbles can be led to the communication port 360 of the first storage chamber along the first partition wall 420 or the second partition wall 421 by making the cartridge 10 in the mounting state. Thereby, the possibility that bubbles may reach to prism 61 and be attached thereto can be decreased.

Moreover, the injection point may be positioned in the second partitioned storage chamber 346 (FIG. 11). The prism 61 is not positioned in the opening direction 362V which is toward the first member storage chamber 344 of the communication port 362 of the second storage chamber. Thereby, even though bubbles occur when ink is injected from the second partitioned storage chamber 346, the possibility that bubbles may reach the prism 61 through the communication port 362 of the second storage chamber can be decreased.

Particularly, the communication port 362 of the second storage chamber is formed on the lower end of the second partitioned storage chamber 346 in the mounting state (FIG. 11). Moreover, the opening direction 362V of the communication port 362 of the second storage chamber is the vertical direction in the mounting state. Thereby, even when bubbles occur in the second partitioned storage chamber 346, bubbles can be caught at the second partitioned storage chamber 346 by making the cartridge 10 in the mounting state. Moreover, at the time of use when the cartridge 10 is mounted on the holder 2 and used, even when bubbles occur in the first member storage chamber 344, bubbles can be caught at the second partitioned storage chamber 346 which is positioned above the first member storage chamber 344. That is, the possibility that bubbles may reach the prism 61 can be decreased.

In addition, the injection point may be positioned in the first partitioned storage chamber 342 (FIG. 11). Thereby, ink can be injected from the first partitioned storage chamber 342 which is different from the first member storage chamber 344 in which the prism 61 is disposed. Accordingly, even when bubbles occur at the time of the ink injection, the possibility that the generated bubbles may reach the prism 61 can be decreased.

Here, in the channel which includes the communication port 360 of the first storage chamber at the middle of the channel, the communication port 360 of the first storage chamber has the smallest channel cross-sectional area (FIG. 11). Thereby, even though bubbles occur when the first partitioned storage chamber 342 is injected from ink, large bubbles can be disrupted to become small bubbles when the bubbles pass through the communication port 360 of the first storage chamber. Since large bubbles become small bubbles, the bubble can be easily dissolved in the ink, and the time in which bubbles exist in the ink can be decreased. Thereby, the possibility that bubbles may reach the prism 61 can be further decreased. Moreover, since large bubbles are disrupted to become small bubbles, the possibility that large bubbles may reach the prism 61 and are attached thereto can be decreased. Accordingly, occurrence of erroneous detection of the ink residual quantity state can be decreased.

In addition, the injection point may be positioned in the liquid communication channel 330 (FIG. 9). The liquid communication channel 330 is positioned between the first storage chamber 350 and the second storage chamber 302 in the flow direction of the fluid. Accordingly, ink is injected from the liquid communication channel 330, and thus, the ink can be introduced to the first storage chamber 350 and the second storage chamber 302 at the same timing.

Moreover, the injection point may be disposed in the second storage chamber 302 (FIG. 9). Thereby, ink can be injected from the second storage chamber 302 which is different from the first storage chamber 350 in which the prism 61 is disposed, and thus, even when bubbles occur at the time of the ink injection, the possibility that the generated bubbles may reach the prism 61 can be decreased.

Here, in the channel which includes the one end opening 311 at the middle of the channel, the one end opening 311 has the smallest channel cross-sectional area (FIG. 9). Thereby, even though bubbles occur when ink is injected from the second storage chamber 302, the bubbles can be disrupted to become small. Thereby, dissolution of bubbles into the ink can be promoted. In addition, since large bubbles which are attached to the prism 61 and generate erroneous detection of the ink residual quantity state are disrupted to become small bubbles, the possibility that large bubbles may reach the prism 61 and be attached thereto can be decreased. Thereby, occurrence of erroneous detection of the ink residual quantity state can be decreased.

Moreover, the injection point may be positioned at the downstream side of the gas-liquid separation film 56 in the atmosphere introduction channel 110. Thereby, since the gas-liquid separation film 56 is not disposed in the channel from the ink injection point to the liquid storage chamber 120, impediment of the flow of ink toward the liquid storage chamber 120 due to the gas-liquid separation film 56 does not occur. Thereby, ink can be effectively stored in the liquid storage chamber 120.

Moreover, the injection point may be disposed in the air chamber 245 in the atmosphere introduction channel 110 (FIG. 9). Thereby, ink can be injected to the air chamber 245 which is a wide space which is formed over the upper surface 13 of the cartridge 10 and the bottom surface 14. Accordingly, for example, the possibility that the liquid injection tube 835 may be erroneously inserted into other channels and ink injection may be performed from other channels can be decreased. Moreover, since ink is injected from the air chamber 245 which is different from the first atmosphere channel 210 in which the gas-liquid separation film 56 is disposed, the possibility that the gas-liquid separation film 56 may be wetted by ink at the time of the ink injection can be decreased. Thereby, the possibility that the original function, in which gas transmits and liquid does not transmit, may be decreased due to clogging of the gas-liquid separation film 56 can be decreased.

Here, the injection point may be positioned in the first air chamber 244 in the air chamber 245 (FIG. 9). Thereby, even when bubbles occur in the first chamber 244 at the time of the ink injection, since the ink is injected from the portion away from the prism 61, the possibility that bubbles may reach the prism 61 can be decreased.

Moreover, the injection point may be disposed in the second air chamber 248 in the air chamber 245 (FIG. 9). Here, the second air chamber 248 includes air-chamber plate members 304 and 305 which are disposed so as to interpose the communication hole 250 along the bottom surface 245*b*. Thereby, even when bubbles occur in the second air chamber 248 at the time of the ink injection, the possibility that the bubbles may penetrate the communication hole 250 from the second air chamber 248 can be decreased due to the air-chamber plate members 304 and 306. Accordingly, the possibility that bubbles may reach the prism can be decreased.

Here, the air-chamber plate members 304 are disposed with intervals in the vertical direction so as to be opposite to each other. Accordingly, the possibility that the bubbles may penetrate the communication hole 250 from the second air chamber 248 can be further decreased. Moreover, bubbles can be caught between two air-chamber plate members 304. From the above, the possibility that bubbles may reach the prism can be further decreased.

In addition, the injection point may be positioned in the second atmosphere introduction channel 254 (FIG. 10). Thereby, in the channel 140, ink can be injected from the second atmosphere introduction channel 254 which is positioned at the position away from the prism 61 and at the position close to the liquid storage chamber 120. Accordingly, ink can be effectively stored in the liquid storage chamber 120. Moreover, even when bubbles occur at the time of the ink injection, the possibility that the generated bubbles may reach the prism 61 can be decreased.

Here, the second atmosphere introduction channel 254 includes the narrow atmosphere channel 254*a* (FIG. 10) in which the channel cross-sectional area is smaller than the surrounding channel cross-sectional areas by the member which partitions and forms the supply channel 388 (FIG. 10). Thereby, when the injection point is positioned at the upstream side of the narrow atmosphere channel 254*a*, since bubbles penetrating the downstream side can be suppressed due to the narrow atmosphere channel 254*a*, the possibility that bubbles may reach the prism 61 can be decreased.

B. MODIFICATION EXAMPLE

As described above, one embodiment of the present invention is described. However, the present invention is not limited to the embodiment and may adopt various configurations within a scope which does not depart from the gist of the invention. For example, the following modifications are possible.

B-1. FIRST MODIFICATION EXAMPLE

In the above-described embodiment, the cartridge 10 in which ink is stored in the liquid storage chamber 120 can be manufactured according to the manufacturing method. However, the present invention is not limited to this, and the present invention may also be applied to a liquid supply unit in which ink can be continuously injected to the cartridge 10 from the outside of the cartridge 10.

Figure 16:
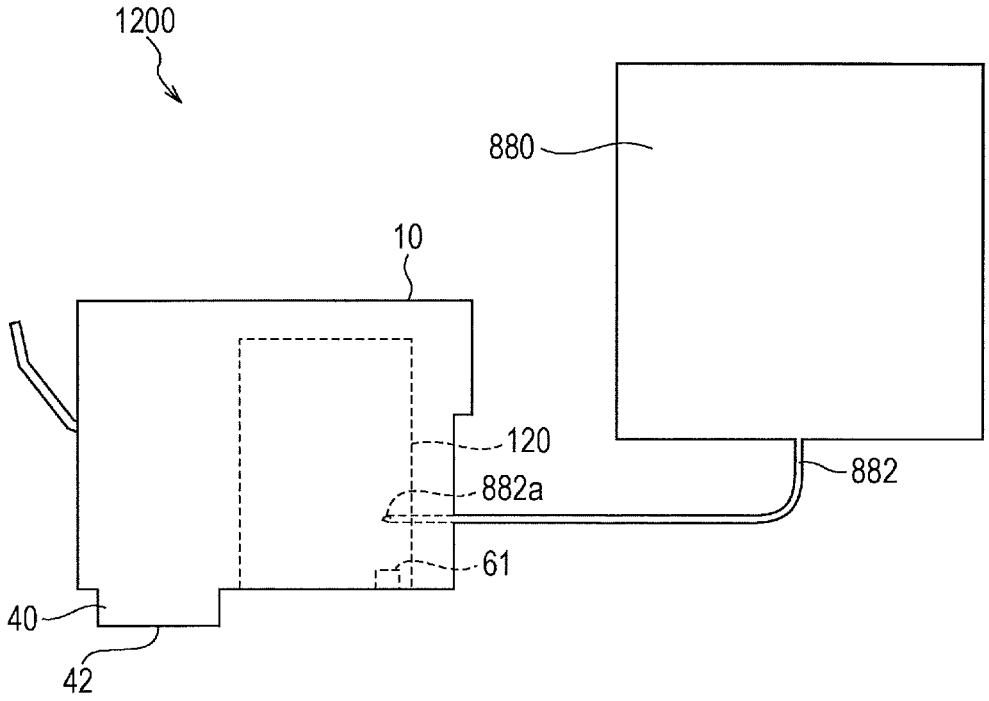
FIG. 16 is a view for illustrating a liquid supply unit 1200.

FIG. 16 is a view for illustrating a liquid supply unit 1200. The liquid supply unit 1200 includes the cartridge 10 described in the embodiment, a liquid tank 880 which is disposed outside the cartridge 10, and a circulation tube 882. The liquid tank 880 can store a large amount of (for example, an amount which is more than the volume of the liquid storage chamber 120) ink. The circulation tube 882 causes the liquid tank 880 and the cartridge 10 to communicate with each other. A tip 882*a* of the circulation tube 882 through which the ink is flowed out is positioned in the liquid storage chamber 120 in the channel 140 or at the upstream side of the liquid storage chamber 120. Thereby, even when the ink in the cartridge 10 is consumed by the printer 1, the ink can be continuously injected (replenished) to the cartridge 10 using the liquid tank 880.

B-2. Second Modification Example:

In the above-described embodiment, in the liquid injection process, the liquid injection tube 835 is mounted by forming the injection port (steps S202 and S204). However, means of performing the ink injection is not limited to this. For example, a portion of the film 55 (FIG. 5A) is peeled off, the liquid injection tube 835 is inserted into the peeled gap, and the ink may be injected to the inner portion of the cartridge 10.

B-3. THIRD MODIFICATION EXAMPLE

In the above-described embodiment, in the liquid injection process, ink is sucked using the sucker 940, and thus, the ink is introduced from the upstream side of the valve member 73 to the downstream side. However, the introduction of ink to the downstream side of the valve member 73 is not limited to this. For example, at the time of the step S208, a jig is inserted from inside the liquid supply portion 40, and the valve member 73 may be forcibly opened. Thereby, at the time of the step S208, ink can be introduced to the downstream side of the valve member 73.

B-4. FOURTH MODIFICATION EXAMPLE

In the above-described embodiment, the first member 61 uses the prism 61. However, the present invention is not limited to this. For example, the first member 61 may be any member if the reflection state of the light of the surface 62 is changed according to the state of the surface 62. In addition, for example, the first member 61 may be a member which is used for detecting the ink residual quantity state using optical means. Moreover, for example, the first member may be a member (for example, a member which includes an electrode pair) in which the signals output to the outside are changed according to characteristics of the surrounding fluid. In addition, for example, the first member may be a member (for example, a piezoelectric vibration element) which is used for detecting the ink residual quantity state of the cartridge 10 in addition to the prism 61.

B-5. FIFTH MODIFICATION EXAMPLE

In the above-described embodiment, the cartridge 10 is mounted on the holder 2 (a so-called on-carriage). However, the cartridge may be mounted on a mounting portion which is provided in a location other than the holder 2 (a so-called off-carriage).

B-6. SIXTH MODIFICATION EXAMPLE

The present invention is not limited to the ink jet printer and the ink cartridge, and may be applied to an arbitrary liquid ejecting apparatus which consumes liquids other than the ink and a liquid container which is used in the liquid ejecting apparatus. For example, the present invention may be applied to liquid containers which are used in various liquid ejecting apparatuses as follows:

(1) An image recording apparatus such as a facsimile machine (2) A color material ejecting apparatus which is used for manufacturing a color filter for an image display apparatus such as a liquid crystal display (3) An electrode material ejecting apparatus which is used for forming an electrode such as an organic electro luminescence (EL) display or a field emission display (FED)

(4) A liquid ejecting apparatus which ejects liquid which includes a living-body organic material which is used for manufacturing a biochip (5) A sample ejecting apparatus which is a precision pipette (6) An ejecting apparatus of lubricating oil (7) An ejecting apparatus of a resin liquid (8) A liquid ejecting apparatus which ejects lubricating oil to a precision machine such as a clock or a camera by a pin point.

(9) A liquid ejecting apparatus which ejects a transparent resin liquid such as an ultraviolet ray-curable resin liquid onto a substrate for forming a micro-hemisphere lens (an optical lens) or the like which is used in an optical communication element or the like

(10) A liquid ejecting apparatus which ejects an acidic or alkali etching liquid for etching a substrate or the like

(11) A liquid ejecting apparatus which includes a liquid consumption head which discharges minute amounts of other arbitrary liquid droplets Further, the "liquid droplet" designates a liquid state discharged from the liquid ejecting apparatus, and may include granular, tear-shaped, threadlike trailed droplets. Moreover, the "liquid" described here may be any material that the liquid ejecting apparatus can consume. For example, it is preferable that the "liquid" be a material in a state where the material is a liquid phase, and the "liquid" includes sol, gel water, other inorganic solvent, organic solvent, solution, liquid resin, and a material of liquid state such as liquid metal (molten metal) as well as a material of high or low viscosity liquid state. In addition, the "liquid" not only includes liquid which is a state of a material but also liquid or the like in which particles of functional material consisting of solid materials such as pigments or metal particles are dissolved, distributed or mixed in solvent. Further, as described in the embodiments, the ink or the liquid crystal is mentioned as a representative example of the liquid. Here, the ink includes general water-based inks and oil-based inks, and various liquid compositions such as gel inks or hot melt inks.

B-7. SEVENTH MODIFICATION EXAMPLE

As above, various aspects are described. However, the following aspects can be adopted.

Moreover, in the following aspects, for reference, the reference numerals in the embodiments are attached to constituent elements by parentheses.

Aspect 1. There is provided a liquid container (10) for storing liquid supplied to a liquid ejecting apparatus (1) including: a first storage chamber (350) for storing the liquid; a first member (61) which is disposed in the first storage chamber (350) and in which a reflection state of light of a surface (62) is changed according to a refractive index of a fluid which comes into contact with the surface (62); a liquid guiding channel (130) in which a supply port (42) connected to the liquid ejecting apparatus (1) is formed on one end, and which communicates with the first storage chamber (350) and circulates the liquid of the first storage chamber (350) to the liquid ejecting apparatus (1) through the supply port (42); and an atmosphere introduction channel (110) in which an atmosphere opening port (19) for introducing the atmosphere is formed on one end, and communicates with the first storage chamber (350) and circulates the atmosphere introduced from the atmosphere opening port (19) into the first storage chamber (350), the first member (61) is disposed on a first member disposition surface (350*b*) which is one of a plurality of outer wall surfaces which partitions and forms the first storage chamber (350), and the first storage chamber (350) includes a first inner wall (424) which is disposed in the inner portion and provided so as to cover the first member (61) at a position above the first member (61) in a mounting state in which the liquid container (10) is mounted on the liquid ejecting apparatus (1) disposed in a horizontal plane. According to the aspect 1, bubbles which exist in a portion above the first inner wall are broken due to the first inner wall, and thus, the possibility that droplets of the liquid may attached to the first member can be decreased. Thereby, detection accuracy of a residual quantity state of the liquid using the first member can be improved.

Aspect 2. In the liquid container (10) according to the aspect 1, the first inner wall (424) is inclined so as to be gradually higher in the mounting state from one end (424*a*) connected to the outer wall surface which partitions and forms the first storage chamber (350) toward the opened other end (424*b*). According to the aspect 2, even when bubbles occur in the space between the first inner wall and the first member in the first storage chamber, the bubbles can be led in the direction (for example, an up direction) away from the first member along the first inner wall. Thereby, the possibility that bubbles may reach the first member and be attached thereto can be decreased.

Aspect 3. In the liquid container (10) according to the aspect 2, the first inner wall (424) includes a notch in which the liquid can pass through the end surface. According to the aspect 3, when the liquid container is used, the possibility that liquid may remain on the first inner wall can be decreased.

Aspect 4. In the liquid container (10) according to the aspect 3, the notch is provided at a position which comes into contact with one end or at a position which is close to the one end, in an end surface of the first inner wall (424). According to the aspect 4, in the mounting state, the liquid which remains on the first inner wall flows from the other end to one end. Accordingly, since the notch is provided at the position which comes into contact with the one end or at the position which is close to the one end, it is possible to prevent the liquid from remaining on the first inner wall.

Aspect 5. In the liquid container (10) according to any one of the aspects 1 to 4, the first storage chamber (350) includes: a plurality of partitioned storage chambers (344, 342, and 346) which are partitioned by a plurality of partition walls; and a plurality of storage chamber communication ports (360 and 362) which are formed so that the liquid circulates between the plurality of partitioned storage chambers and formed by a gap between opened ends (420*p* and 421*p*) of the partition wall and the outer wall surface of the first storage chamber (350), and the plurality of partitioned storage chamber include: a first member storage chamber (344) which includes a first member disposition surface (350*b*) and in which the first inner wall (424) is provided in the inner portion; a first partitioned storage chamber (342) which directly communicates with the upstream side of the first storage chamber, directly communicates with the first member storage chamber (344) by a communication port (360) of a first storage chamber which is one of the plurality of storage chamber communication ports, and is disposed above the first member storage chamber (344) in the mounting state; and a second partitioned storage chamber (346) which does not directly communicate with the first partitioned storage chamber (342) but directly communicates with the first member storage chamber (344) by a communication port (362) of a second storage chamber (302) which is the other one of the plurality of storage chamber communication ports. According to the aspect 5, the first storage chamber can be partitioned into the plurality of partitioned storage chambers which communicate with each other. Thereby, the possibility that bubbles may reach the first member can be decreased.

Aspect 6. In the liquid container (10) according to the aspect 5, an upper surface in the mounting state of the first member (61) storage chamber includes: a first partition wall (420) which partitions the first member storage chamber (344) and the first partitioned storage chamber (342) in the plurality of partition walls; and a second partition wall (421) which partitions the first member (61) storage chamber and the second partitioned storage chamber (346) in the plurality of partition walls, and each of the first partition wall (420) and the second partition wall (421) is inclined so as to be gradually higher in the mounting state as the walls approach the communication port (360) of the first storage chamber from the one ends (420*a* and 420*p*) and are toward the other ends (420*p* and 421*a*). According to the aspect 6, even when bubbles occur in the first member storage chamber at the time of the ink injection, at the time of transporting, or the like, the bubbles can be led to the communication port of the first storage chamber by making the liquid container in the mounting state. Thereby, the possibility that bubbles may reach the first member and be attached thereto can be decreased.

Aspect 7. In the liquid container (10) according to the aspect 5 or 6, in the mounting state, the second partitioned storage chamber (346) is positioned above the first member storage chamber (344) and is provided in a position which does not overlap with the first member (61) when the liquid container (10) is vertically projected on the horizontal plane, and the communication port (362) of the second storage chamber (302) is formed so that the first member (61) is not positioned in an opening direction (362V). According to the aspect 7, since the first member is not positioned in the opening direction of communication port of the second storage chamber, even when bubbles exist in the second partitioned storage chamber, the possibility that the bubbles may reach the first member through the communication port of the second storage chamber can be decreased.

Aspect 8. In the liquid container (10) according to the aspect 7, the communication portion (362) of the second storage chamber (302) is formed on the lower end of the second partitioned storage chamber (346) in the mounting state, and the opening direction (362V) includes a vertical direction component in the mounting state. According to the aspect to 8, even when bubbles exist in the first storage chamber, the bubbles can be led to the second partitioned storage chamber which is positioned above the first member storage chamber in the mounting state. Thereby, the quantity of bubbles in the first member storage chamber can be decreased, and the possibility that the bubbles may reach the first member can be decreased.

Aspect 9. In the liquid container (10) according to any one of the aspects 5 to 8, in the flow direction of the liquid which circulates from the first partitioned storage chamber (342) to the first member storage chamber (344) through the communication port (360) of the first storage chamber, a channel, which includes the communication port (360) of the first storage chamber at the middle of the channel in the first storage chamber (350), has the smallest channel cross-sectional area at the communication port of the first storage chamber (350). According to the aspect 9, even when bubbles occur in the first partitioned storage chamber, the bubbles can be caught when the bubbles pass through the communication port of the first storage chamber. Therefore, the possibility that bubbles may reach the first member can be further decreased. Moreover, large bubbles can be disrupted to become small bubbles due to the communication port of the first storage chamber.

Aspect 10. In the liquid container (10) according to any one of the aspects 5 to 9, a notch (420*r*) in which the liquid can pass through the end surface is formed on at least a portion of the plurality of partition walls. According to the aspect 10, even when bubbles stay in the storage chamber communication port of the first storage chamber and circulation of the liquid between the plurality of partitioned storage chambers through the storage chamber communication port is impeded, the liquid can be circulated between the plurality of partitioned storage chambers through the notch.

Aspect 11. In the liquid container (10) according to any one of the aspects 5 to 10, in the flow direction of the fluid from the atmosphere opening port (19) to the supply port (42), the liquid container further includes: a second storage chamber (302) for storing the liquid which is positioned at the upstream side of the first storage chamber (350); and a liquid communication channel (330) which is to communicate with the first storage chamber (350) and the second storage chamber (302) in which one end opening (311) directly communicates with the second storage chamber (302) and the other end opening (315) directly communicates with the first storage chamber (350), a channel which includes the one end opening (311) at the middle of the channel has the smallest channel cross-sectional area at the one end opening (311). According to the aspect 11, even when bubbles occur in the second storage chamber, many bubbles can be caught when the bubbles pass through the one end opening. Accordingly, the possibility that bubbles may reach the first member can be further decreased. Moreover, large bubbles can be disrupted to become small bubbles due to the one end opening.

Aspect 12. In the liquid container (10) according to any one of the aspects 1 to 11, the atmosphere introduction channel (110) includes an air chamber (245) at the middle of the channel, the air chamber (245) includes: a first air chamber (244); and a second air chamber (248) which is partitioned to the first air chamber (244) by a partition wall (402) disposed inside the air chamber (245) and is positioned below the first air chamber (244) in the mounting state, and the partition wall (402) includes a notch (246) for causing the first air chamber (244) and the second air chamber (248) to communicate with each other. According to the aspect 12, even when bubbles occur in the second air chamber, large bubbles can be disrupted to become small bubbles when the bubbles pass through the notch. Moreover, according to the aspect 12, even when the liquid reversely flows from the first storage chamber toward the atmosphere opening port, the flow of the liquid toward the atmosphere opening port can be suppressed due to the partition wall.

Aspect 13. In the liquid container (10) according to the aspect 12, the atmosphere introduction channel (110) further includes: a first atmosphere introduction channel (110) in which one end is the atmosphere opening port (19), the other end communicates with the air chamber (245), and the gas-liquid separation film (56) is disposed at the middle of the channel (110); and a second atmosphere introduction channel (254) for causing the air chamber (245) and the first storage chamber (350) to communicate with each other, and the second air chamber (248) includes: an air chamber communication hole (250) for directly communicating with the second atmosphere introduction channel (254); and an air-chamber plate member (306 and 304) which is disposed so as to interpose the air chamber communication hole (250) along a portion of the wall surfaces which partitions and forms the second storage chamber (302) and extends in a horizontal direction in the mounting state. According to the aspect 13, even when bubbles occur in the upstream side of the air-chamber plate member, bubbles penetrating the downstream side can be suppressed due to the air-chamber plate member. Moreover, even when the liquid in the first storage chamber reversely flows toward the atmosphere opening port due to the transporting or the like of the liquid container, the reverse flow of the liquid can be suppressed by the air-chamber plate member.

Aspect 14. In the liquid container (10) according to the aspect 13, a plurality of the air-chamber plate members (306 and 304) are provided, and the plurality of air-chamber plate members (306 and 304) are disposed with intervals in a vertical direction in the mounting state. According to the aspect 14, even when bubbles occur in the upstream side of the air-chamber plate member, the bubbles penetrating the downstream side can be suppressed due to the plurality of air-chamber plate members. Moreover, even when the liquid in the first storage chamber reversely flows toward the atmosphere opening port due to the transporting or the like of the liquid container, the reverse flow of the liquid can be suppressed by the plurality of air-chamber plate members.

Aspect 15. In the liquid container (10) according to the aspect 13 or 14, the second atmosphere introduction channel (254) includes a narrow atmosphere channel (254*a*) which is formed so that a channel cross-sectional area is smaller than the surrounding channel cross-sectional area by a member (388) forming the liquid guiding channel (130). According to the aspect 15, even when bubbles occur in the upstream side of the narrow atmosphere channel, the bubbles penetrating the downstream side can be suppressed due to the narrow atmosphere channel. Thereby, the possibility that bubbles may reach the first member can be decreased.

Aspect 16. In the liquid container (10) according to any one of the aspects 1 to 15, the liquid guiding channel (130) and the first storage chamber (350) directly communicate with each other by a liquid communication hole (369) which is the other end of the liquid guiding channel (130), and the liquid communication hole (369) is provided at a position which does not overlap with the first inner wall (424) when the liquid container (10) is vertically projected on the horizontal plane in the mounting state, and is provided so as to come into contact with the first member disposition surface (350*b*). According to the aspect 16, since the liquid communication hole is provided at the position which does not overlap with the first inner wall, even when bubbles penetrate the first storage chamber through the liquid communication hole, the possibility that the bubbles may stay in the vicinity of the first inner wall can be decreased. Thereby, the possibility that bubbles may reach the first member can be decreased.

Aspect 17. In the liquid container (10) according to the aspect 16, the first storage chamber (350) includes a plate-shaped bottom surface partition wall (425) which is disposed in the inner portion of the chamber (350) and extends from the first member disposition surface (350*b*) and in which the liquid communication hole (369) is formed along a thickness direction in a lower end (425*d*) which comes into contact with the first member disposition surface (350*b*), the bottom surface partition wall (425) is provided at a position which does not overlap with the first inner wall (424) when the wall (425) is vertically projected, and a first main surface (425*c*) which faces the first member (61) in the bottom surface partition wall (425) extends in the vertical direction in the mounting state from the disposition surface (350*b*) of the first member (61). According to the aspect 17, the first main surface extends in the vertical direction from the first member disposition surface. Thereby, even when bubbles penetrate the first storage chamber through the liquid communication hole, the bubbles can be led along the first main surface. Accordingly, the possibility that bubbles may reach the first member can be decreased.

Aspect 18. In the liquid container (10) according to the aspect 17, in the mounting state, at least a portion of an upper end (425*a*) of the bottom surface partition wall (425) is inclined so as to include portions having different heights. According to aspect 18, bubbles led along the first main surface can be introduced to the wider space due to the lower portion in the upper end of the bottom surface partition wall.

Aspect 19. In the liquid container (10) according to any one of the aspects 16 to 18, the liquid container includes: a first surface (14) which forms a portion of an outer surface (62) of the liquid container (10) and in which a liquid supply portion (40), in which the supply port (42) is formed on the end, is disposed so as to protrude; a second surface (16) which forms a portion of the outer surface (62) and crosses the first surface (14); and a third surface (15) which forms a portion of the outer surface (62), crosses the first surface (14), and is opposite to the second surface (16), the first member (61) is disposed at a position closer to the second surface (16) than the third surface (15) in an opposite direction (the X axis direction) in which the second surface (16) and the third surface (15) are opposite to each other, the first storage chamber (350) is disposed at the side opposite to the second surface (16) while interposing the first member (61) in the opposite direction and includes a communication surface (370*a*) which is disposed so as to be close to the liquid communication hole (369) in the position above the liquid communication hole (369) in the mounting state, and the communication surface (370*a*) gradually approaches the third surface (15) in the opposite direction from the lower side toward the upper side in the mounting state. According to the aspect 19, even when bubbles penetrate the first storage chamber through the liquid communication hole, the bubbles can be lead to the direction away from the first member due to the communication surface. Thereby, the possibility that bubbles may reach the first member can be decreased.

Aspect 20. In the liquid container (10) according to any one of the aspects 16 to 19, a portion of the liquid communication hole (369) is configured by a notch which is formed on one of a plurality of walls included in the first storage chamber (350). According to the aspect 20, the liquid communication hole can be easily formed.

Aspect 21. In the liquid container (10) according to any one of the aspects 16 to 20, the liquid guiding channel (130) includes a first through channel (370) which communicates with the first storage chamber (350) through the liquid communication hole (369) and linearly extends, and the opening area of the liquid communication hole (369) is smaller than the channel cross-sectional area of the first through channel (370). According to the aspect 21, even when bubbles penetrate the first storage chamber through the liquid communication hole from the first through channel, the bubbles can be caught by the liquid communication hole. Thereby, the possibility that bubbles may reach the first member can be decreased. Moreover, large bubbles can be disrupted to become small bubbles due to the liquid communication hole.

Aspect 22. In the liquid container (10) according to any one of the aspects 16 to 21, in the order from the upstream side to the downstream side in the flow direction of the fluid from the atmosphere opening port (19) to the supply port (42), the liquid guiding channel (130) includes: a first liquid channel (372) which is formed at a side opposite to the side in which the first storage chamber (350) is formed and include a portion (372*a*) which extends along the vertically upward direction in the mounting state from the upstream side toward the downstream side; a second liquid channel (378) which is formed at the same side as the side in which the first storage chamber (350) is formed and includes a portion (378*a*) which extends along the vertically downward direction in the mounting state from the upstream side toward the downstream side; and a valve chamber (79) in which a valve unit (70) for opening and closing the liquid guiding channel (130) is disposed. According to the aspect 22, the first liquid channel and the second liquid channel include channels which extend in directions opposite to each other. Accordingly, even when bubbles occur in the downstream side of the second channel, the possibility that bubbles may reach the first storage chamber can be decreased.

REFERENCE NUMERALS

1: liquid ejecting apparatus (printer)
2: holder
3: first motor
4: second motor
5: optical detection device
5*a*: light-emitting element
5*b*: light-receiving element
6: control unit
7: operation portion
8: interface
9: computer
10: liquid container (cartridge)
11: cover member
12: container main body
12*p*: wall
13: upper surface (upper surface wall portion and fourth surface)
14: bottom surface (bottom surface wall portion and first surface)
14*a*: wall
14*p*: wall
15: front surface (front surface wall portion and third surface)
16: rear surface (rear surface wall portion and second surface)
17: right surface (right surface wall portion and fifth surface)
18: left surface (left surface wall portion and sixth surface)
19: atmosphere opening port
20: lever
30: circuit substrate
31: substrate terminal
33: spring
40: liquid supply portion
42: supply port
43: spring
44: spring seat
46: seal member
48: supply unit
51, 52, 54, and 55: film
56: gas-liquid separation film
60: first member unit
61: prism (first member)
61*s*: first portion
62: surface
62*a*: first surface
62*b*: second surface
70: valve unit
71: spring seat
72: spring
73: valve member
79: valve chamber
84: decompression hole
84*a*: decompression chamber
110: atmosphere introduction channel
110*a*: first atmosphere introduction channel
120: liquid storage chamber
130: liquid guiding channel
140: channel
200: grooves
210: first atmosphere channel
212: communication hole
214: meandering channel
220: gas-liquid separation chamber
222: bank
230: communication hole
234: second atmosphere channel
235*a*: upper surface
236: communication hole
238: third atmosphere channel
240: communication hole
244: first air chamber
245: air chamber
245*a*: upper surface
245*b*: bottom surface
246: communication hole
248: second air chamber
249: communication hole
250: communication hole
254: third atmosphere channel (second atmosphere introduction channel)
254*a*: narrow atmosphere channel
256: communication hole
300: wall (rib)
302: second storage chamber
304: air-chamber plate member
306: air-chamber plate member
308: communication hole
309: first liquid communication channel
310: second liquid communication channel
311: one end opening
312: communication hole

313: communication hole
314: third liquid communication channel
315: other end opening
316: fourth liquid communication channel
330: liquid communication channel
342: first partitioned storage chamber
344: first member storage chamber
344*t*: first bottom chamber
344*w*: second bottom chamber
344*w*1: first division chamber
344*w*2: second division chamber
346: upper storage chamber (second partitioned storage chamber)
350: first storage chamber
350*b*: first member disposition surface
360: communication port of the first storage chamber
362: communication port of the second storage chamber
362V: opening direction
369: liquid communication hole
370: first through channel (narrow channel)
370*a*: communication surface
372: first liquid channel
372*a*: channel
376: communication hole
378: second liquid channel
378*a*: channel
380: communication hole
381: valve hole
382: first vertical channel
384: communication hole
388: supply channel
402: partition wall
408: partition wall
420: first partition wall
420*a*: one end
420*b*: first separation wall
420*c*: second separation wall
420*p*: other end
420*r*: communication hole
421: second partition wall
421*a*: other end
421*p*: one end
424: first inner wall
424*a*: one end
424*b*: other end
424*r*: communication hole
425: bottom surface partition wall
425*a*: upper end
425*c*: first main surface
425*d*: lower end
602: attaching portion
604: base portion
800: liquid injection unit
802: vacuum unit
805: injection instrument
810: tank
820: injection pump
830: valve
835: liquid injection tube
835*a*: tip
840: vacuum pump
850: vacuum chamber
860: valve
865: suction tube
880: liquid tank
882: circulation tube
882*a*: tip
900: liquid supply needle
940: sucker
945: suction tube
1000: liquid ejecting system
1200: liquid supply unit

What is claimed is:

1. A method of manufacturing a liquid container configured to supply liquid to a liquid ejecting apparatus, the method comprising:

(a) a process of preparing a liquid container that includes a liquid storage chamber configured to store the liquid, a transparent member disposed in the liquid storage chamber, a supply port configured to supply the liquid to outside, a liquid guiding channel that communicates with the supply port and the liquid storage chamber the liquid guiding channel including a channel in which the cross-sectional are is smaller than an area of an arbitary cross-section passing through the transparent member, an atmosphere opening port configured to introduce air from the outside, and an atmosphere introduction channel that communicates with the atmosphere opening port and the liquid storage chamber, the liquid storage chamber including:

a first storage chamber positioned in a channel from the atmosphere opening port to the supply port and which the transparent member is disposed; and a second storage chamber positioned in the channel from the atmosphere opening port to the supply port, the first storage chamber being closer to the supply port than the second storage chamber in the channel, and (b) a process of injecting the liquid from an injection port to the liquid storage chamber or an upstream of the liquid storage chamber in the channel from the atmosphere opening port to the supply port.

2. The method of manufacturing a liquid container according to claim 1, wherein in the process (b), the liquid is injected via the injection port to the first storage chamber, the injection port being formed on the first storage chamber.

3. The method of manufacturing a liquid container according to claim 2, wherein in the process (b), the liquid is injected to the first storage chamber via the injection port in a manner that an inner of the first storage chamber can be viewed from the outside through the transparent member.

4. The method of manufacturing a liquid container according to claim 2, wherein the first storage chamber includes:

a transparent member storage chamber in which the transparent member is disposed;

a first partitioned storage chamber which directly communicates with the transparent member storage chamber and is disposed above the transparent member storage chamber when the liquid container is mounted on the liquid ejecting apparatus;

a second partitioned storage chamber which directly communicates with the transparent member storage chamber but does not directly communicate with the first partitioned storage chamber; and a first inner wall which is positioned between an upper portion of the transparent member storage chamber and the transparent member and which is inclined when the liquid container is mounted on the liquid ejecting apparatus.

5. The method of manufacturing a liquid container according to claim 4, wherein the upper portion of the first member storage chamber includes, a first partition wall which partitions the first member storage chamber and the first partitioned storage chamber and a second partition wall which partitions the first member storage chamber and the second partitioned storage chamber, and each of the first partition wall and the second partition wall is inclined toward a first storage communication port which causes the first partitioned storage chamber and the transparent member storage chamber to communicate with each other, wherein in the process (b), the injection port is formed on the transparent member storage chamber and the liquid is injected via the injection port the transparent member storage chamber.

6. The method of manufacturing a liquid container according to claim 5, wherein in the process (b), the transparent member storage chamber includes a first bottom chamber positioned between the first inner wall and bottom portion of the transparent member storage chamber when the liquid container is mounted on the liquid ejecting apparatus, and the liquid is injected via the injection port to the first bottom chamber.

7. The method of manufacturing a liquid container according to claim 5, wherein the transparent member storage chamber includes:

a first bottom chamber which is positioned between the first inner wall and a bottom portion of the transparent member storage chamber when the liquid container is mounted on the liquid ejecting apparatus; and a second bottom chamber which is a portion other than the first bottom chamber, wherein in the process (b), the liquid is injected via the injection port to the second bottom chamber.

8. The method of manufacturing a liquid container according to claim 7, wherein the second bottom chamber includes:

a first division chamber which has the first inner wall as a bottom portion and a portion of the first partition wall as an upper portion; and a second division chamber which has the other portion of the first partition wall and the second partition wall as an upper portion, wherein in the process (b), the liquid is injected via the injection port the first division chamber.

9. The method of manufacturing a liquid container according to claim 7, wherein the second bottom chamber includes:

a first division chamber which has the first inner wall as a bottom portion and a portion of the first partition wall as an upper portion; and a second division chamber which has the other portion of the first partition wall and the second partition wall as an upper portion, wherein in the process (b), the liquid is injected via the injection port to the second division chamber.

10. The method of manufacturing a liquid container according to claim 4, wherein the second partitioned storage chamber is positioned above the transparent member storage chamber and is provided in a position which does not overlap with the first member when the liquid container is mounted on the liquid ejecting apparatus, and a communication port of the second storage chamber which causes the second partitioned storage chamber and the transparent member storage chamber to communicate with each other is formed so that the first member is not positioned in an opening direction, wherein in the process (b), the liquid is injected via the injection port to the second partitioned storage chamber.

11. The method of manufacturing a liquid container according to claim 10, wherein the communication port of the second storage chamber is formed in a lower portion of the second partitioned storage chamber when the liquid container is mounted on the liquid ejecting apparatus, and the opening direction includes a vertical direction component.

12. The method of manufacturing a liquid container according to claim 4, wherein in the process (b), the liquid is injected via the injection port to the first partitioned storage chamber.

13. The method of manufacturing a liquid container according to claim 1, wherein the liquid container includes an atmosphere introduction channel, and a gas-liquid separation film is disposed at the middle of the atmosphere introduction channel, wherein in the process (b), the liquid is injected via the injection port to a portion in the channel from downstream of the gas-liquid separation film to the supply port.

14. The method of manufacturing a liquid container according to claim 13, wherein the atmosphere introduction channel includes:

a first atmosphere introduction channel in which an end is an atmosphere opening port and the gas-liquid separation film is disposed at the middle of the first atmosphere introduction channel; and an air chamber which communicates with the first atmosphere introduction channel and in which an upper wall of the liquid container forms an upper portion and a bottom wall opposite to the upper wall in the liquid container forms an bottom portion, wherein in the process (b), the liquid is injected via the injection port to the air chamber.

15. The method of manufacturing a liquid container according to claim 14, wherein the air chamber includes:

a first air chamber which includes the upper portion; and a second air chamber which is partitioned to the first air chamber by a partition wall of an inner portion of the air chamber and includes a bottom portion, and a notch which causes the first air chamber and the second air chamber to communicate with each other is formed on the partition wall, wherein in the process (b), the liquid is injected via the injection port the first air chamber.

16. The method of manufacturing a liquid container according to claim 14, wherein the atmosphere introduction channel includes a second atmosphere introduction channel which is positioned in the channel from the atmosphere opening port to the supply port, the second storage chamber being closer to the supply port than the air chamber in the channel, the air chamber includes:

a first air chamber which includes the upper portion; and a second air chamber which communicates with the first air chamber, is partitioned to the first air chamber by a partition wall of an inner portion of the air chamber, and includes a bottom portion, the second air chamber includes:

an air chamber communication hole which causes the second air chamber and the second atmosphere introduction channel communicate with each other; and an air-chamber plate member which is disposed so as to interpose the air chamber communication hole along the bottom portion and extends in a horizontal direction, wherein in the process (b), the liquid is injected via the injection port to the second air chamber.

17. A liquid container is manufactured by the method of manufacturing a liquid container according to claim 1.

18. A method of manufacturing a liquid container configured to supply liquid to a liquid ejecting apparatus, the method comprising:

(a) a process of preparing a liquid container that includes a liquid storage chamber configured to store the liquid, a transparent member disposed in the liquid storage chamber, a supply port configured to supply the liquid to outside, a liquid guiding channel that communicates with the supply port and the liquid storage chamber, the liquid guiding channel including a channel in which the cross-sectional area is smaller than an area of an arbitrary cross-section passing through the transparent member, an atmosphere opening port configured to introduce air from the outside, and an atmosphere introduction channel that communicates with the atmosphere opening port and the liquid storage chamber, the liquid storage chamber including:

a first storage chamber positioned in a channel from the atmosphere opening port to the supply port and in which the transparent member is disposed;

a second storage chamber positioned in the channel from the atmosphere opening port to the supply port, the first storage chamber being closer to the supply port than the second storage chamber in the channel; and a liquid communication channel which causes the first storage chamber and the second storage chamber to communicate with each other, an injection port formed on the liquid communication channel, and (b) a process of injecting the liquid via the injection port to the liquid communication channel.

19. A method of manufacturing a liquid container configured to supply liquid to a liquid ejecting apparatus, the method comprising:

(a) a process of preparing a liquid container that includes a liquid storage chamber configured to store the liquid, a transparent member disposed in the liquid storage chamber, a supply port configured to supply the liquid to outside, a liquid guiding channel that communicates with the supply port and the liquid storage chamber, the liquid guiding channel including a channel in which the cross-sectional area is smaller than an area of an arbitrary cross-section passing through the transparent member, an atmosphere opening port configured to introduce air from the outside, and an atmosphere introduction channel that communicates with the atmosphere opening port and the liquid storage chamber, the liquid storage chamber including:

a first storage chamber positioned in a channel from the atmosphere opening port to the port and in which the transparent member is disposed a second storage chamber positioned in the channel from the atmosphere opening port to the supply port, the first storage chamber being closer to the supply port than the second storage chamber in the channel, an injection port being formed on the second storage chamber; and a liquid communication channel which causes the first storage chamber and the second storage chamber to communicate with each other, and (b) a process of injecting the liquid via the injection port to the second storage chamber.

20. The method of manufacturing a liquid container according to claim 19, wherein the liquid communication channel includes, one end opening which causes the liquid communication channel and the second storage chamber to communicate with each other, and other end opening which causes the liquid communication channel and the first storage chamber to communicate with each other, wherein a cross-sectional area of the one end opening is smaller than a cross-sectional area of an arbitrary position of the liquid communication channel.

* * * * *